US009608317B2

(12) United States Patent
Rahman et al.

(10) Patent No.: US 9,608,317 B2
(45) Date of Patent: Mar. 28, 2017

(54) SYSTEM, METHOD AND APPARATUS INCLUDING HYBRID SPIRAL ANTENNA

(71) Applicants: Nahid Rahman, Rupnagar (BD); Mohammed N. Afsar, Somerville, MA (US)

(72) Inventors: Nahid Rahman, Rupnagar (BD); Mohammed N. Afsar, Somerville, MA (US)

(73) Assignee: Trustees of Tufts College, Medford, MA (US)

( * ) Notice: Subject to any disclaimer, the term of this patent is extended or adjusted under 35 U.S.C. 154(b) by 171 days.

(21) Appl. No.: 14/312,360

(22) Filed: Jun. 23, 2014

(65) Prior Publication Data

US 2014/0300526 A1 Oct. 9, 2014

Related U.S. Application Data

(63) Continuation of application No. PCT/US2012/071422, filed on Dec. 21, 2012.

(60) Provisional application No. 61/630,987, filed on Dec. 23, 2011.

(51) Int. Cl.

| | |
|---|---|
| ***H01Q 1/36*** | (2006.01) |
| ***H01Q 21/00*** | (2006.01) |
| ***H01Q 7/00*** | (2006.01) |
| ***H01Q 9/27*** | (2006.01) |

(52) U.S. Cl.

CPC ..... *H01Q 1/36* (2013.01); *H01Q 7/00* (2013.01); *H01Q 9/27* (2013.01); *H01Q 21/00* (2013.01)

(58) Field of Classification Search

CPC ..... H01Q 1/36; H01Q 21/00; H01Q 7/00

USPC ..... 343/867, 866, 895

See application file for complete search history.

(56) References Cited

U.S. PATENT DOCUMENTS

| | | | | |
|---|---|---|---|---|
| 5,053,786 A * | 10/1991 | Silverman | H01Q 1/36 | 343/895 |
| 5,621,422 A * | 4/1997 | Wang | H01Q 1/36 | 343/700 MS |
| 6,191,756 B1 * | 2/2001 | Newham | H01Q 9/27 | 343/895 |
| 2005/0007293 A1 * | 1/2005 | Handelsman | H01Q 7/005 | 343/867 |
| 2010/0066624 A1 * | 3/2010 | Masuda | H01Q 9/27 | 343/787 |

FOREIGN PATENT DOCUMENTS

JP 2007-102348 A 4/2007

OTHER PUBLICATIONS

Lipsky, Stephen E., Antenna Elements for Microwave Passive Direction Finding, Microwave Passive Direction Finding, SciTech Publishing, pp. 36-67, 1987.

(Continued)

*Primary Examiner* — Dameon E Levi
*Assistant Examiner* — Walter Davis
(74) *Attorney, Agent, or Firm* — Bergman & Song LLP; Michael Bergman

(57) ABSTRACT

A spiral antenna device includes a plurality of generally polygonal loops. The polygonal loops have respective side counts that decrease progressively as a function of the loop's radial distance from a center of the antenna device. The side count may vary between loops as a multiple of a power of two.

24 Claims, 18 Drawing Sheets

(56) References Cited

OTHER PUBLICATIONS

Caswell, Eric D., Design and Analysis of Star Spiral With Application to Wide Band Arrays With Variable Element Sizes. Digital Library an Archives, University Libraires, Virginia Tech, pp. 75-126, 2001.

Kramer, Brad A., et al., Design and Performance of an Ultrawide-Band Ceramic-Loaded Slot Spiral, IEEE Transactions on Antennas and Propagation, vol. 53, No. 7, pp. 2193-2194, Jul. 2004.

Balanis, Constantine A., Aperature Antennas, *Antenna Theory: Analysis Design*, 3rd Edition, John Wiley & Sons, Inc., pp. 653-738, 2005.

Gustafsson, Mats, Broadband array antennas using a self-complementary antenna array and dielectric slabs, Technical Report LUTEDX/(TEAT-7129)/1-8/(2004), 1-8.

Saynak, Ugur and Kustepeli, ALP, Novel Square Spiral Antennas for Broadband Application, Frequez 63, 1-2, pp. 14-19, 2009.

Palreddy, Sandeep and Cheung, Rudolf, Two-arm Archimedean Spiral Helical Antenna with Wraparound Absorber, 25th Annual Review of Progress in Applied Computational Electromagnetics, ACES, 6pp, 2009.

Rahman, Nahid, et al., Characterization, Design and Optimization of Low-Profile Cavities for UWB Spiral Antennas, International Journal of Electromagnetics and Applications, 2(3), pp. 16-23, 2012.

Nakano, Hisamatsu, Helical and Spiral Antennas, Encyclopedia of Telecommunications, John Wiley & Sons, Inc., published online Apr. 15, 2003, http://dx.doi.org/10.1002/0471219282.eot235.

Navarro, Julio A., Spatial and Quasi-Optical Power Combining. Encyclopedia of RF and Microwave Engineering, pp. 4837-4879, published online Apr. 15, 2005.

Antenna Magus, http://www.antennamagus.com/database/antennas/antenna_page.php?id=95.

* cited by examiner

SYSTEM, METHOD AND APPARATUS INCLUDING HYBRID SPIRAL ANTENNA

CROSS-REFERENCE TO RELATED APPLICATIONS

The present application is a Continuation of PCT application number PCT/US2012/071422 having an international filing date of Dec. 21, 2012 the disclosure of which is herewith incorporated by reference in its entirety, which in turn claims the benefit of U.S. provisional patent application No. 61/630,987, filed on Dec. 23, 2011, the disclosure of which is herewith incorporated by reference in its entirety.

FIELD OF THE INVENTION

The present invention relates to electromagnetic radiation, and more particularly to apparatus and methods for coupling an electronic device to an electromagnetic field.

BACKGROUND

Various devices, known generally as antennas, are advantageously employ to couple an electronic device to a time varying electromagnetic field. In diverse applications, antennas are used to couple power into and out of an electromagnetic field and to transmit and receive signalingly modulated electromagnetic fields. Circular spiral antennas have been used in a number of such applications. They are desirable for, among other characteristics, the production of circularly polarized electromagnetic radiation. A circularly polarized receiving antenna will receive a portion of an incoming signal regardless of the spatial orientation of the receiving antenna. Consequently, circular polarization is used extensively in communications applications where an orientation of a transmitting or receiving antenna may be altered in a way that is unpredictable or otherwise undesirable. For example, systems for communicating with orbiting and extra-orbital spacecraft typically employ circular polarization.

A square spiral antenna is a known variant of a circular spiral antenna. Square spiral antennas have certain advantages over circular spiral antennas. These advantages are particularly evident with respect to relatively low frequencies of electromagnetic radiation.

Notwithstanding their long use and well understood theory, circular and square spiral antennas exhibit deficiencies for which no satisfactory remedy has previously been presented. The corresponding long-felt, but unsatisfied need for improved devices is at last addressed in the substance of the present disclosure. Indeed, the present invention emerges from new insights and understanding of these deficiencies developed by the present inventors and reflected in the novelty of the corresponding inventions.

SUMMARY

Having thus examined and understood a range of previously available devices, the inventors of the present invention have developed a new and important understanding of the problems associated with the prior art and, out of this novel understanding, have developed new and useful solutions and improved devices, including solutions and devices yielding surprising and beneficial results.

The invention encompassing these new and useful solutions and improved devices is described below in its various aspects with reference to several exemplary embodiments including a preferred embodiment.

Planar Archimedean spiral antennas are most often designed to operate in two principal configurations, i.e. circular and rectangular. Based on the requirements of a specific application, both configurations have their advantages and disadvantages. For instance, square spirals have the advantage of operating with similar gain performance at lower frequencies than their circular counterparts.

In accordance with the current band theory, the first radiation band of a spiral antenna occurs when the circumference of the spiral is one current wavelength at the operating frequency. This circumference corresponds to:

$$D=\lambda_e/\pi \quad 1)$$

for the circular case, where D is diameter and $\lambda_e$ is effective wavelength and, for the square case:

$$W=\lambda_e/4 \quad 2)$$

where W is the side length of the square and where $\lambda_e$ is the effective wavelength. Therefore, the first operating frequency is approximately 22% lower for a square spiral than that of a circular one when they both have the same diameter. This means that for a given frequency, the first radiation mode of a square spiral antenna will occur at a smaller radius than for the corresponding circular spiral allowing for better utilization of available aperture. The longer circumference of square spirals provide an inherent miniaturization factor $MF=4/\pi$. Consequently, square spiral antennas can be packaged closer together than circular spirals in an array configuration when constrained to the same space or whenever a square mounting footprint is required.

The fundamental advantage, however, of using spiral antenna systems is the radiation of circularly polarized waves over ultra-wide bandwidths. Although square spirals allow for compact packaging, they often demonstrate irregular performance across the band and commonly have poor axial ratio performance compared to their circular Archimedean counterparts. A commonly accepted figure of merit for circularly polarized antennas (antennas can be either circular or rectangular spiral antennas) is that their axial ratios should remain below 3 dB across their entire frequency range of operation.

In recent work, modified logarithmic and modified hybrid rectangular geometries have been proposed to improve the performance of conventional square Archimedean spirals. Such devices, however, generally have axial ratios greater than 4 dB over a significant portion of their operational bandwidths. In other work, the use of high-contrast dielectric materials in slot spirals has been shown to improve the axial ratio to some extent at ultra high frequencies (UHF: 0.5-2 GHz). The above-noted deterioration of axial ratio for square spirals operating at ultra wideband (UWB) frequencies, (i.e. UWB: 2-18 GHz) is effectively overcome by various antennas prepared according to principles of the present invention, while maintaining the advantages of the square spiral.

One of the several exemplary embodiments and variants of the present invention presented below is a wideband spiral antenna having a 16 turn generally polygonal spiral structure. The structure includes innermost loops with 32 sides each, as well as four additional loops having 16 sides each. In addition the structure includes four further loops of eight sides each and another four outermost loops having four sides each.

Of course, it will be understood that the corresponding spiral slot antenna would also fall within the scope of the invention. Such antenna includes, as an example, an electrically conductive body member, such as a copper plate, having first and second substantially planar surfaces, i.e., flat sides disposed substantially parallel to one another. Polygonal spiral slots through the copper plate are arranged in loops like those described immediately above to form radiating spiral apertures.

The slots or members (depending on the embodiment) are arranged in an Archimedean spiral, or in a modified Archimedean spiral according to the requirements of a particular embodiment. As will be discussed in additional detail below, the loops may include interpolated loops, including single interpolated loops and/or a progression of interpolated loops providing a transition between polygonal spiral loops of different configurations. In one exemplary embodiment, an overall linear dimension of about 2 inches characterizes a spiral antenna according to the invention. Antennas having a wide variety of other dimensions are also contemplated. In other embodiments, a plurality of such antennas forms an array.

One of skill in the art will anticipate a wide variety of performance characteristics according to the particular dimensions and features of corresponding embodiments. That said, certain embodiments of the invention can be expected to exhibit a radiating bandwidth from at least about 2 GHz to at least about 18 GHz. Likewise, certain embodiments of the invention can be expected to exhibit an axial ratio over such a radiating bandwidth of at most about 3.5 dB, and in some cases less than 3 dB over most of the radiating bandwidth. Similarly, a voltage standing wave ratio (VSWR) over the radiating bandwidth of at most about 2.5 can be anticipated.

While different embodiments will exhibit a corresponding variety of input impedance characteristics, preparing an antenna having an input impedance of about 188Ω will be within the skill of the ordinary practitioner in light of the present disclosure. In addition, the practitioner of ordinary skill in the art will appreciate that providing an absorbing cavity or other absorbing device proximate to one face of the spiral will substantially limit an effective transmission or reception lobe to the opposite side of the spiral.

These and other advantages and features of the invention will be more readily understood in relation to the following detailed description of the invention, which is provided in conjunction with the accompanying drawings.

It should be noted that, while the various figures show respective aspects of the invention, no one figure is intended to show the entire invention. Rather, the figures together illustrate the invention in its various aspects and principles. As such, it should not be presumed that any particular figure is exclusively related to a discrete aspect or species of the invention. To the contrary, one of skill in the art would appreciate that the figures taken together reflect various embodiments exemplifying the invention.

DETAILED DESCRIPTION

The following description is provided to enable any person skilled in the art to make and use the disclosed inventions and sets forth the best modes presently contemplated by the inventors of carrying out their inventions. In the following description, for purposes of explanation, many specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the substance disclosed.

Figure 1A:
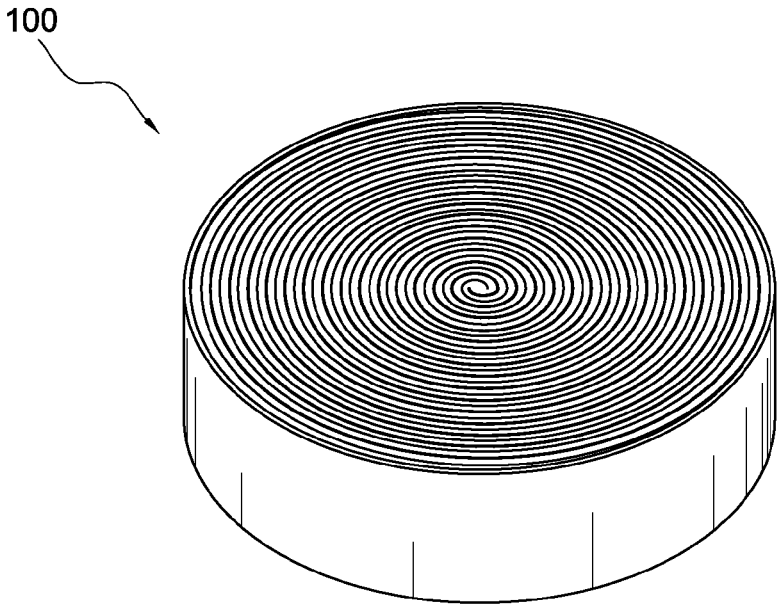
FIG. 1A shows, in schematic perspective view, a circular spiral antenna device prepared according to a design of the present inventors.
Figure 1B:
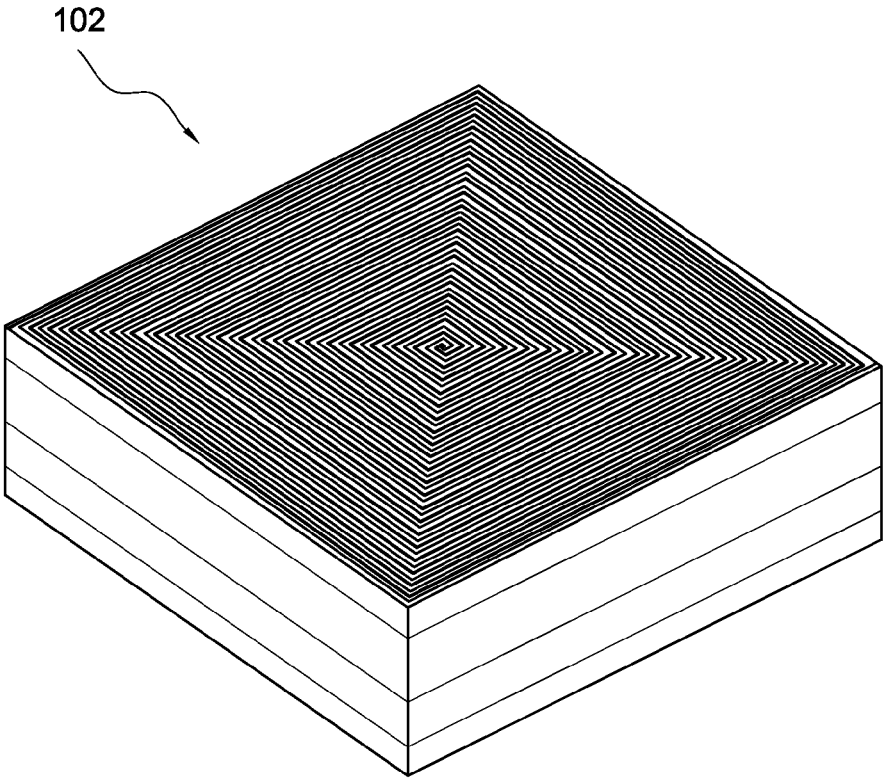
FIG. 1B shows, in schematic perspective view, a square spiral antenna device prepared according to a design of the present inventors.

The present invention relates to a system, apparatus and method for producing electromagnetic radiation, including an antenna device having a generally spiral aspect. Certain embodiments of a device prepared according to principles of the invention include a modified polygonal Archimedean spiral antenna well adapted to radiate in a 2-18 GHz bandwidth. Also disclosed is a spiral antenna having performance which approximates a circular spiral antenna (like that shown 100 in FIG. 1A) in its highest frequencies of operation. The spiral antenna further exhibits performance that gradually transitions to approximate that of a square spiral antenna (like that shown 102 in FIG. 1B) at its lowest frequencies of operation. Among other advantages, a device prepared according to the present invention is well adapted to produce circularly polarized waves over ultra-wide bandwidths while embodying low-profile geometries for efficient array packing.

It is well-known that self-complementary structures tend to have a constant input impedance and hence are good candidates for ultra-wideband antennas. Among the advantages of the invention described herewith, many embodiments of antennas prepared according to principles of the invention are substantially self-complementary.

Figure 2:
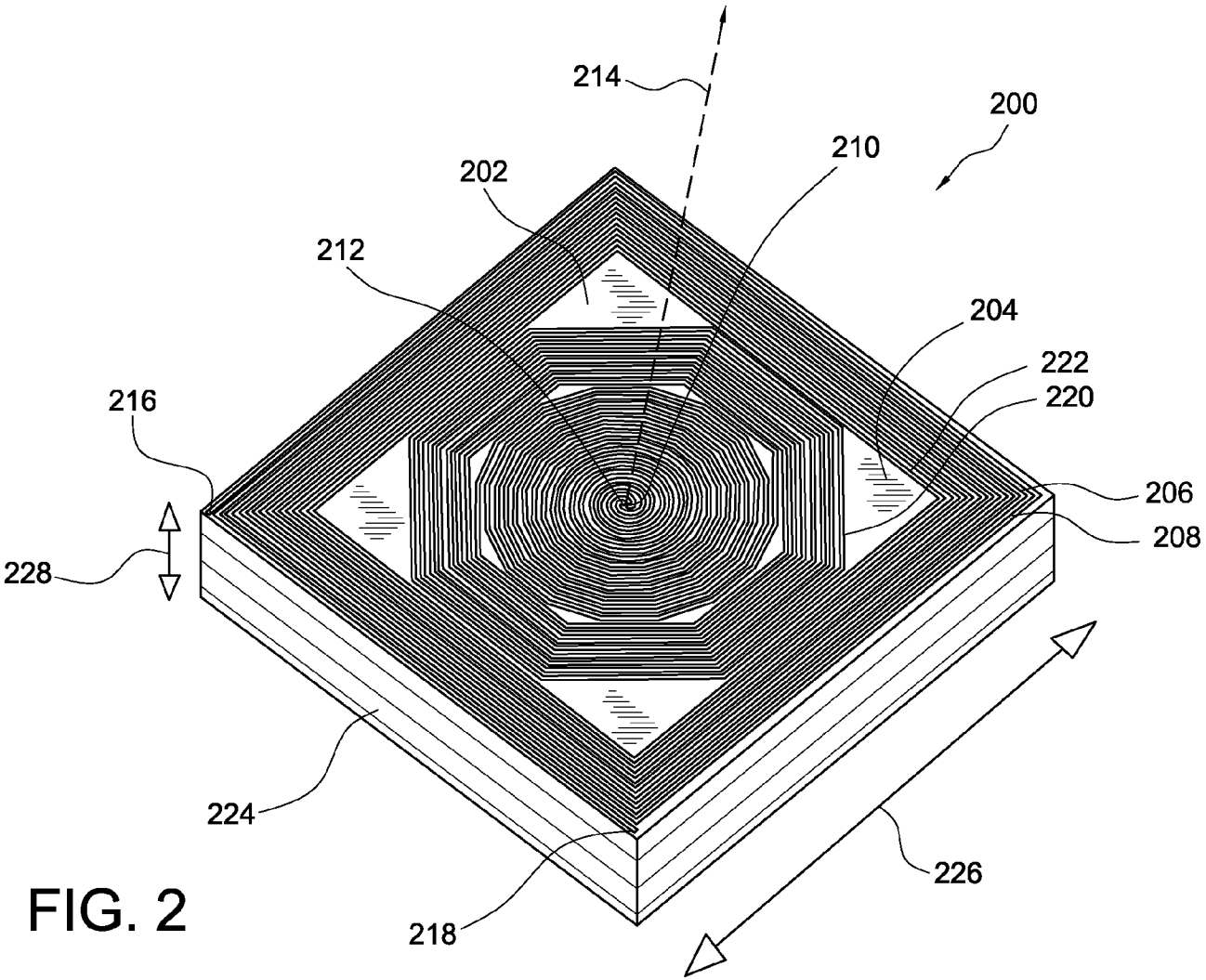
FIG. 2 shows, in schematic perspective view, a hybrid polygonal antenna device prepared according to principles of the invention.

FIG. 2 shows an exemplary two-arm, 16 turn spiral antenna device 200 prepared according to principles of the invention. The illustrated device, includes a substrate member 202 having a substantially planar support surface 204. In a typical embodiment, the substrate member 202 includes material having a substantially electrically insulating characteristic. In some embodiments, the substrate member includes material having the characteristics of an electrical semiconductor. In certain embodiments, the substrate member includes a polymer foam having material constitutive properties (permittivity and permeability) similar to air. For example, one might use Emerson and Cuming® ECCOSTOCK®PP, which is a closed cell, cross-linked hydrocarbon foam with low dielectric loss, low dielectric constant, and low density. This foam is light-weight, weather resistant and has negligible water absorption and provides excellent thermal insulation. The dielectric constant does not change with frequency and any change with temperature is negligible. One of skill in the art will understand that other similar materials may be employed.

First 206 and second 208 spiral arms have respective original ends 210, 212 proximate to a normal central axis 214 of the support surface 204. In addition, the spiral arms 206, 208 have further respective terminal ends 216, 218 comparatively distal to the normal central axis 214. Between the respective original ends 210, 212 and terminal ends 216, 218, each spiral arm describes a generally polygonal spiral wherein radially adjacent loops, e.g. 220, 222 of one arm are disposed substantially co-axial to one another about central axis 214.

In the illustrated embodiment, an absorbing device 224 is disposed in proximity to substrate member 202 and adjacent to a reverse side of the substrate, taken with respect to support surface 204. In other embodiments, the absorbing device 224 is integral to substrate member 202. As will be understood by one of ordinary skill in the art, the absorbing device serves to substantially absorb and prevent the radiation of a rear primary lobe by the spiral antenna device 200.

In the illustrated embodiment, the antenna device 200 is substantially square and has an overall linear dimension 226 of approximately 2 inches. One of skill in the art will appreciate, however, that other dimensions and configurations are possible according to the requirements (e.g., desired radiation wavelength band) of a particular application. In particular, in certain embodiments it will be advantageous to employ an Electromagnetic Band Gap (EBG) material and/or a metamaterial such as is known, or may be developed, in the art in proximity to the spiral device.

In certain embodiments, the absorbing device 224 includes a shallow, multi-layer absorptive cavity with three constituent commercially available absorbing materials. In this demonstration, a front layer at the air-absorber interface (AN series, Emerson and Cumming) includes a carbon-loaded polyurethane foam absorber. A second layer (LS-10055, ARC technologies) includes a flexible, low-density and high loss carbon loaded foam. A metal-backed 3$^{rd}$ layer includes an iron-loaded, magnetic thermoplastic elastomer (WT-BPJA-010, ARC technologies. The illustrated embodiment, according to principles of the invention, includes a cavity depth 228 that ensures 2-18 GHz absorption for maximum gain-bandwidth performance. In certain embodiments, depth 228 is at least about 0.625 inch, including an air-gap between the radiator and the absorbing layers. The cavity is used for unidirectional operation of the spiral antenna and the constituent materials and cavity depth can be adjusted according to application requirements.

Figure 3A:
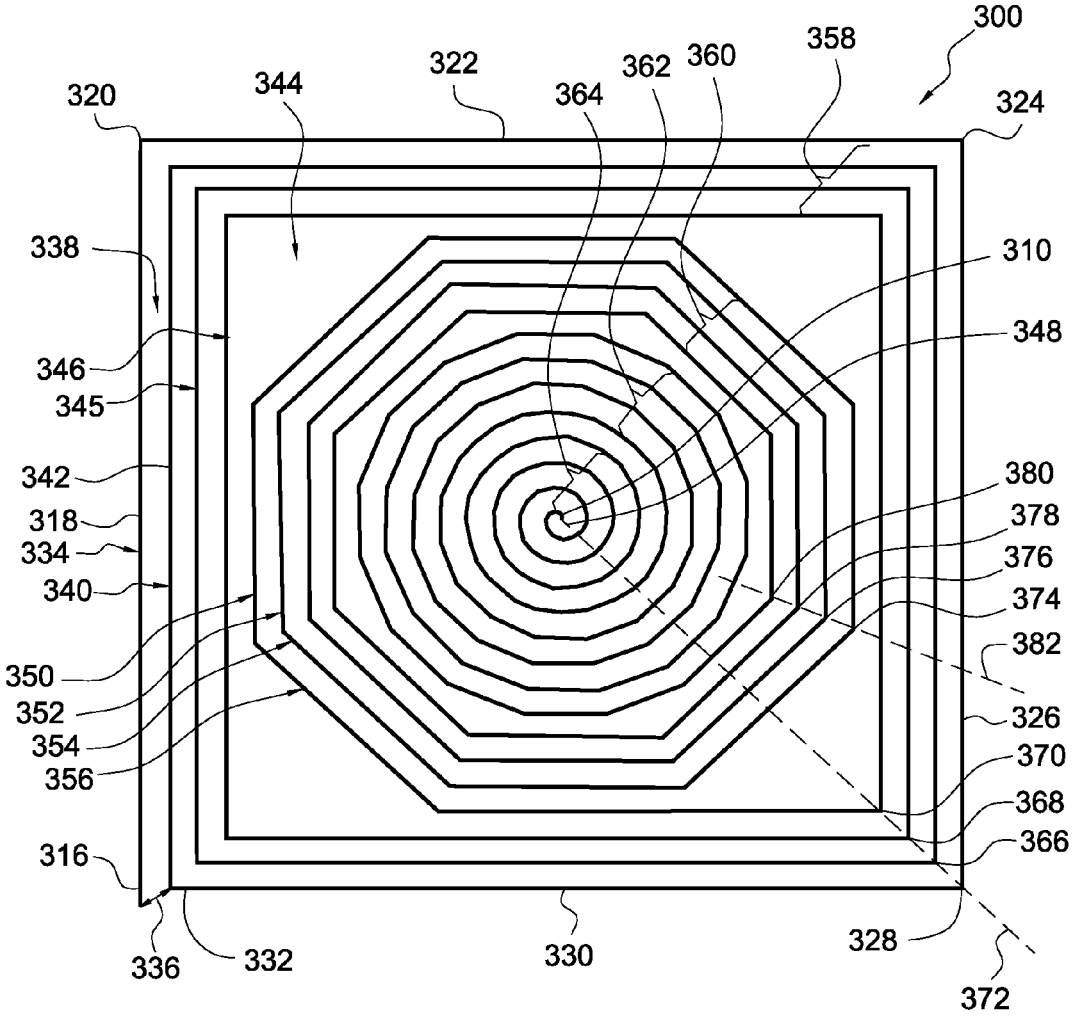
FIG. 3A shows a geometric spiral having characteristics associated with an antenna device prepared according to principles of the invention.

FIG. 3 shows a geometric curve 300 similar to that described by one arm of the spiral antenna device 200 of FIG. 2. The curve is piecewise linear between an inner original end 310 and an outer terminal end 316. A first substantially linear segment 318 is disposed between outer terminal end 316 and a first vertex 320. The first vertex 320 of the illustrated exemplary curve has an angular dimension substantially equal to 90°. A second substantially linear segment 322 is disposed between first vertex 320 and a second vertex 324 which also has an angular dimension substantially equal to 90°. A third substantially linear segment 326 is disposed between second vertex 324 and a third vertex 328 which also has an angular dimension substantially equal to 90°; and a fourth substantially linear segment 330 is disposed between third vertex 328 and a fourth vertex 332. Together, the first 318, second 322, third 326 and fourth 330 substantially linear segments form an outermost loop 334. The outermost loop 334 is regarded as substantially polygonal and, in this case, substantially square because each of vertices 320, 324, 328 and 332 has an angular dimension substantially equal to 90°.

It should be noted that loop 334 is not precisely polygonal, because the respective lengths of the substantially linear segments diminish monotonically between terminal end 316 and vertex 332. For purposes of this application, the term monotonic is intended to refer to a series of values which either remain equal or change in only one sense (i.e., decrease or increase) from value to value through the series. For example, the sequence 10, 9, 8, 8, 8, 6, 5, 4, 4, 4, 3, 0, −7 is considered to be monotonically decreasing. This sequential diminution of segment length results in a radial offset 336 between vertex 332 and terminal end 316, and in a corresponding gap 338 between successive polygonal loops (e.g., between first polygonal loop 334 and a second polygonal loop 340). Nevertheless, for purposes of this disclosure and as noted above, loop 334 is considered to be substantially polygonal.

The region of gap 338 defined between first linear segment 318 and a fifth linear segment 342 is generally rectangular in form. Other regions of the gap will have other configurations, however. For example, the gap 338 is generally triangular at region 344.

Like loop 334, loop 340 may be considered substantially square for purposes of the present application. Similarly, loops 345 and 346 are considered to be substantially square for purposes of the application, and all of loops 334, 340, 345 and 346 are considered to be substantially concentric with respect to each other about a centerpoint 348 of the spiral.

It is worth noting that, where a particular antenna device of the invention has more than one arm, the spiral arms are generally interleaved with one another. Accordingly, a second spiral arm would embody a geometric curve substantially similar in configuration to curve 300. The second spiral arm would be disposed within gap 338 and substantially concentric with spiral 300 about centerpoint 348. Such an arm would divide gap 348 and thus define additional gaps in which still further arms might be disposed, where appropriate. In certain embodiments, the second spiral arm would be disposed such that a linear segment of the second spiral arm would be disposed substantially equidistant between adjacent segments of the first spiral arm. In certain embodiments, the spiral arm is disposed in an orientation that is rotated in the plane of the spiral by approximately 180° with respect to the first spiral arm.

It should also be noted that each of loops 334, 340, 345 and 346 is considered to be substantially square in the illustrated embodiment. Curve 300 includes additional loops 350, 352, 354 and 356, which for purposes of the present disclosure are deemed to be substantially octagonal. Accordingly, curve 300 maybe regarded as having groups of loops 358, 360, 362 and 364; the loops of group 358 being four-sided (i.e., substantially square), the loops of group 360 being eight-sided (i.e., substantially octagonal), the loops of group 362 being 16-sided and the loops of group 364 being 32-sided.

In the illustrated embodiment, the number of sides of the groups are related by powers of 2. Thus, whereas each loop of the outermost group 358 has four sides (2 exponent 2), each loop of group 360 has eight sides (2 exponent 3), each loop of group 362 has 16 sides (2 exponent 4), and each loop of group 364 has 32 sides (2 exponent 5).

Figure 3B:
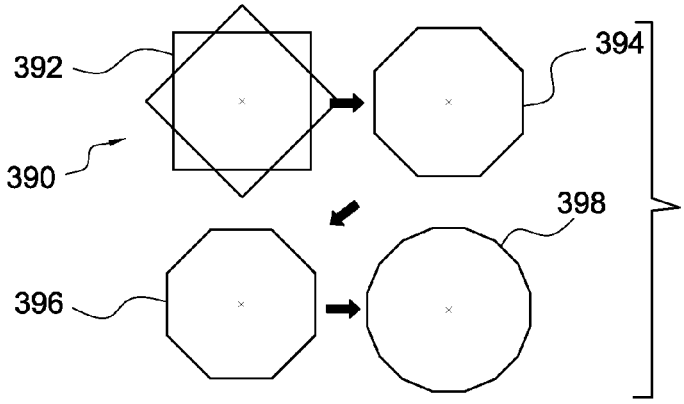
FIG. 3B illustrates design steps related to preparing an exemplary antenna device according to principles of the invention.

FIG. 3B illustrates a graphical method 390 for arriving at this mathematical progression by truncating a related polygon at its vertices, beginning with a square 392. Truncating the corners of the square 392 results in an octagon 394, which may be similarly modified to produce a 16 sided polygon 396. Further modification of the 16 sided polygon 396 produces a 32 sided polygon 398.

A further notable aspect of exemplary curve 300 is that, while the vertices within a group are substantially radially aligned with one another, the vertices of adjacent groups are offset from one another. Thus vertices 328, 366, 368 and 370 are substantially radially aligned along radial axis 372. Likewise, vertices 374, 376, 378 and 380 are substantially radially aligned along radial axis 382. Axes 372 and 382 are not, however, aligned but are disposed at an oblique angle with respect to one another.

The reader will note that, while radial alignment of all vertices within a group is found in certain devices prepared according to the invention, it is absent from other embodiments of the invention. For example, FIGS. 7A, 8A and 9A (discussed below) show further devices prepared according to principles of the invention without the substantial radial alignment of group vertices found in curve 300.

Referring again to FIG. 3 and considering curve 300 more analytically, the Archimedean spiral curve is defined by the polar equation:

$$r=a^*\theta, \text{ where } \theta\geq 0. \quad 3)$$

The system of parametric equations corresponding to the polar curve is:

$$x=a\theta\cos(\theta) \text{ and} \quad 4)$$

$$y=a\theta\sin(\theta), \quad 5)$$

where a is any real number denoting the growth rate of the spiral.

For the polygonal spiral case, when one increases the angle dθ to construct a next group of polygons with half the number of sides of the previous group, if the radius is not appropriately adjusted, the inner polygons will intersect with the outer polygons at some distance along the curve. To correct for the distance between adjacent sides and to ensure that the linear end portion of the next turn of the spiral does not come any nearer than the vertex of the previous side, the parametric equations are modified as:

$$r'=a\theta/\cos(d\theta/2), x=r'\cos(\theta) \text{ and} \quad 6)$$

$$y=r'\sin(\theta). \quad 7)$$

Figure 4:
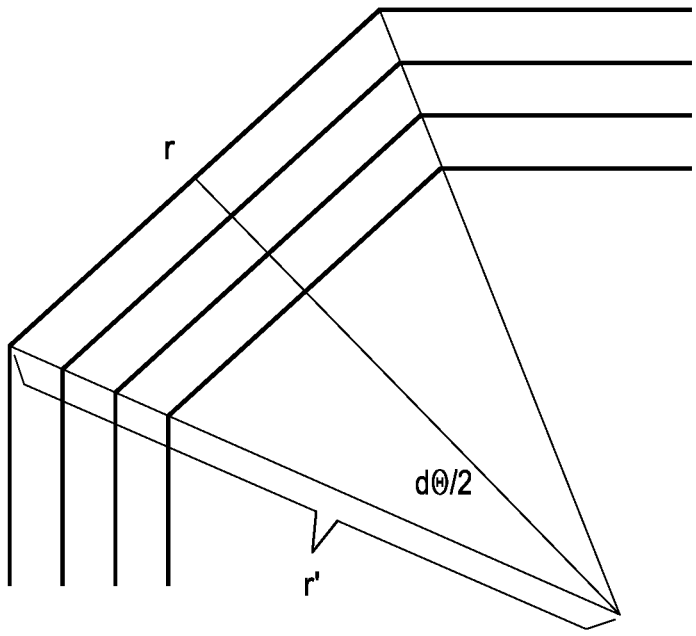
FIG. 4 shows a portion of a geometric spiral illustrating analysis of corresponding parametric equations.

In this way, since cos(dθ/2) is always ≤1, the radius is modified to be slightly larger than the true Archimedean spiral as shown in FIG. 4.

In order to create a particular polygonal loop, the angle of rotation to create the sides is determined from:

$$d\theta=(2\times\pi)/(\#\text{ of sides}) \quad 8)$$

where dθ is the angle of rotation.

When making a transition from a group of $2^n$ sided polygons to $2^{n-1}$ sided polygons, one may choose to make either the flat sides of different polygons parallel to each other or make the vertices group of an inner set of polygons line up with the vertices and centers of an outer group of polygons. The former reduces the irregularity in the transition from $2^n$ side polygon to $2^{n-1}$ sided polygon and best preserves the self-complimentary form of the two-arm spiral. Hence, to ensure a substantially symmetric spiral polygonal structure, with regular transitions from $2^n$ to $2^{n-1}$ sides, the flat sides are preferably designed parallel and centered about the next larger group of sides. Curve 300 of FIG. 3A exemplifies these characteristics.

Figure 5A:
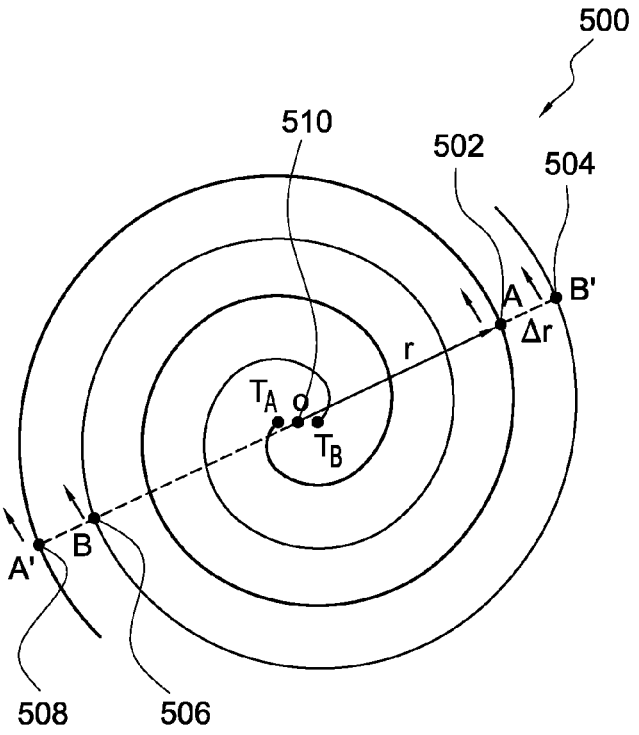
FIG. 5A shows a generally circular geometric spiral.
Figure 5B:
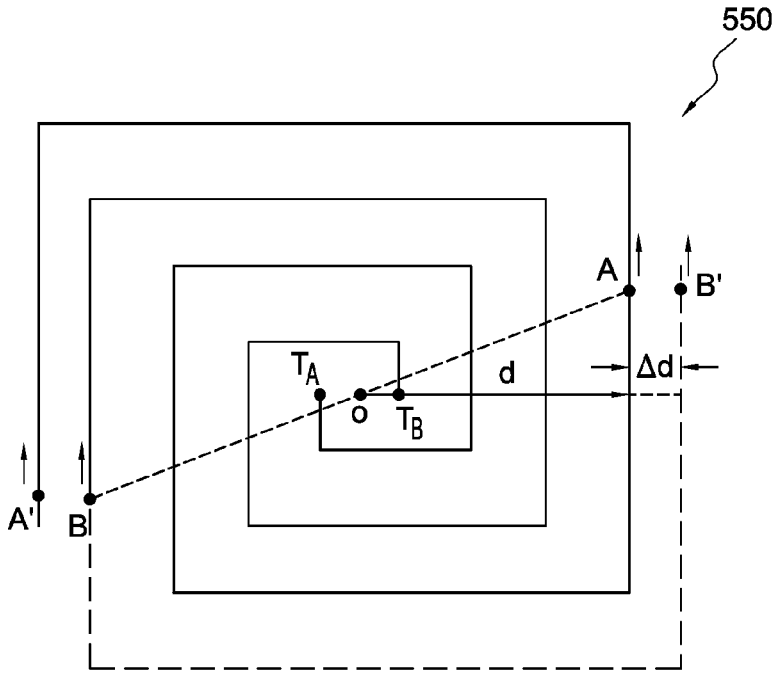
FIG. 5B shows a generally rectangular geometric spiral.

Reference is now made to FIGS. 5A and 5B and to respective idealized spiral antennas 500 and 550. Without intending to be bound to a particular theory of operation, the inventors offer the following observations. According to the current band theory for planar Archimedean spiral antennas, when the total circumferential path length is $\lambda_e$, where $\lambda_e$ is the effective wavelength or current wavelength, the current at A (e.g., 502) and the current at its neighboring point B' (e.g., 504) on the adjacent arm are in phase. Similarly, the current at B (e.g., 506) and the current at its neighboring point A' (e.g., 508) on the adjacent arm are in phase. FIGS. 5A and 5B illustrate these four currents at points A, B', B, and A', where each pair of currents forms a band of current.

Spiral antennas follow the principles of a slow-wave structure. The two current bands in FIGS. 5A and 5B rotate around the center-point o (e.g., 510) with time. Consequently the electric field radiated from each current band also rotates. Therefore, the radiation field is circularly polarized.

For every differential group of elements that have shifted 180 degrees in phase at the diameter of radiation, there is another group that is in time and space quadrature (of equal amplitude and 90° out of phase) since the phase of the groups varies as a function of the spiral growth rate. This causes a 90 degree phase shift making the spiral response circular.

Figure 6:
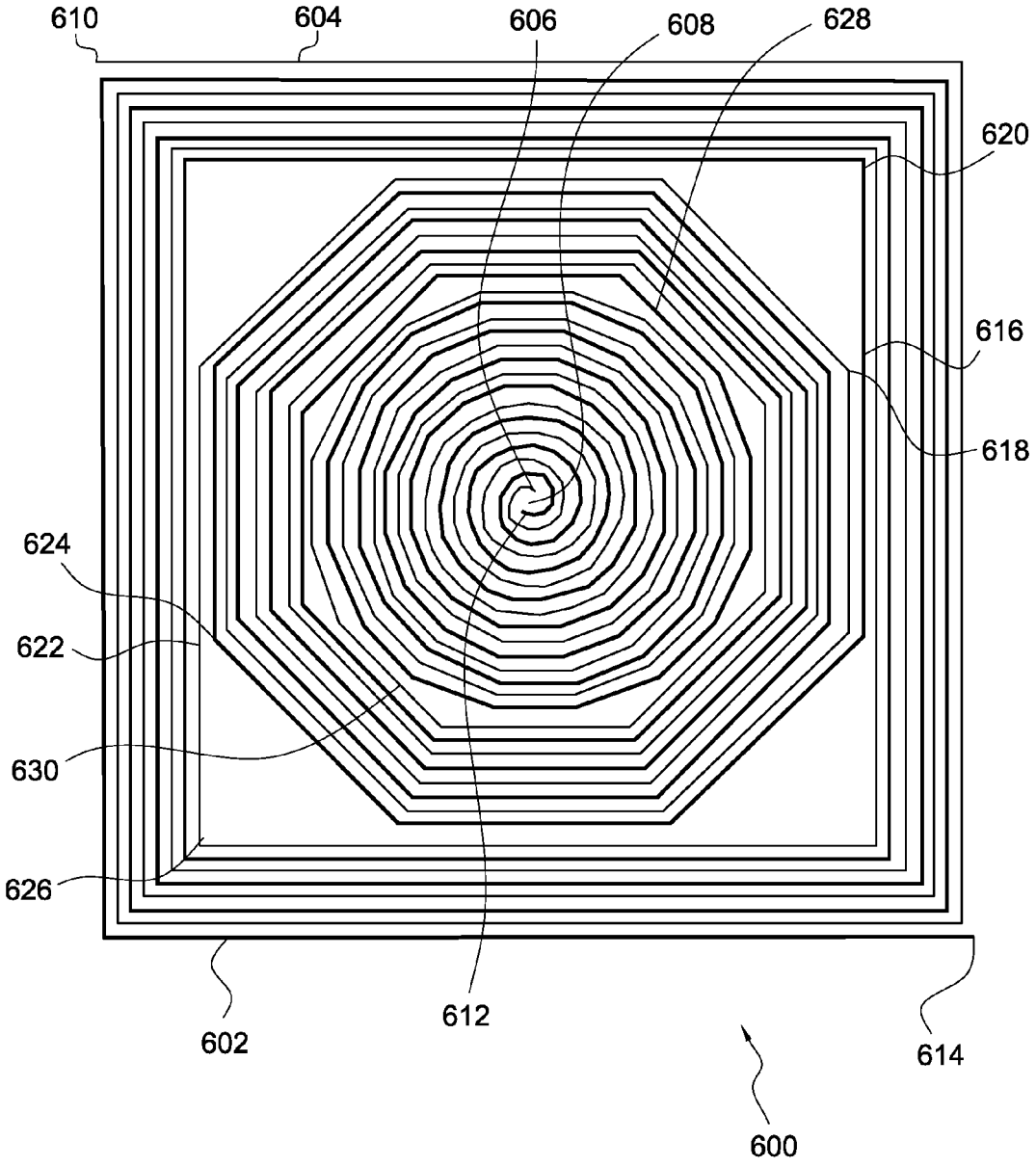
FIG. 6 shows a polygonal geometric curve illustrating certain characteristics of a hybrid polygonal antenna device like that of FIG. 2.

FIG. 6 shows a further aspect of an idealized spiral antenna 600 according to principles of the invention. Antenna 600 incorporates two interleaved piecewise-linear curves 602 and 604, each being substantially similar to curve 300 of FIG. 3. Accordingly, curves 602 and 604 are substantially similar to one another, and are displaced from one another by a rotation of approximately 180° in the plane of the image.

Curve 604 has an original end 606 disposed proximate to a centerpoint 608 and a terminal end 610 relatively radially distant from the centerpoint. In like fashion, curve 602 has an original end 612 and a terminal end 614. Progressing outwardly from the origin along curve 602, one reaches, for example, a transition point 616 where vertex 618 of curve 604 is not matched by a corresponding vertex of curve 602. Rather, curve 602 proceeds in linear fashion to vertex 620, thereby affecting a transition from an octagonal loop to a square loop.

180° away from transition 616, curve 604 effects a similar transition 622. Instead of matching vertex 624 of curve 602, curve 604 proceeds straight to vertex 626 and transitions, from an octagonal loop to a square loop. Depending on the arrangement of a particular antenna, additional transition points will be found wherever loops transition from one polygonal configuration to another. Thus, for example, additional transition points are found in curves 602 and 604 at locations 628 and 630 respectively.

In the illustrated polygonal spiral antenna 600, and others of the present invention, as the two current bands are rotating with time, when the effective wavelength is such that the current band or the same phase currents between the adjacent arms reaches a point where one arm is transitioning the antenna geometry from a $2^n$ side polygon to a to a $2^{n-1}$ side polygon, while the other arm remains in a $2^n$ sided polygonal turn, the currents are no longer in phase in the vicinity of the transition point. Furthermore, another differential group of currents in phase quadrature may not be available. This absence or diminution of currents in phase quadrature can result in an elevated axial ratio (e.g., above 3 dB) at corresponding radiation frequencies. Consequently, it is preferable to reduce the effect of transition points to the extent practical. As will be discussed below in additional detail, one approach to minimizing the effects of transitions between groups of loops is to provide extrapolated loops. Such extrapolated loops serve to make the transition between groups more gradual.

Figure 7A:
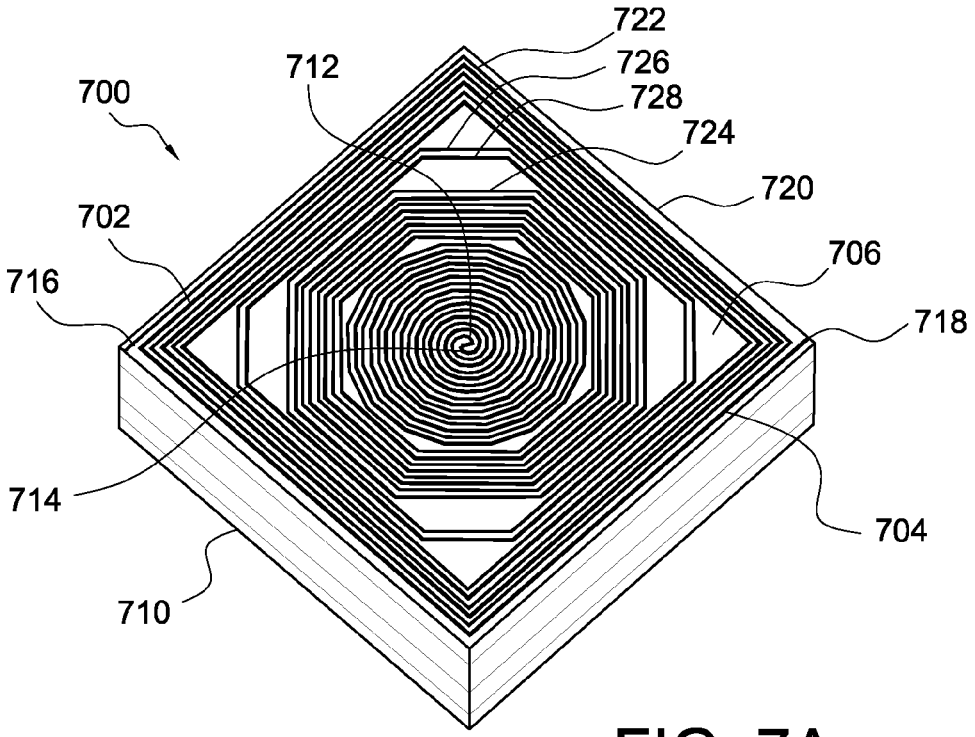
FIG. 7A shows, in schematic perspective view, a hybrid polygonal antenna device prepared according to principles of the invention.

FIG. 7A shows a further example of a polygonal spiral antenna 700 prepared according to principles of the invention including extrapolated loops that moderate the effect of inter-group transitions. As illustrated, antenna 700 has two spiral arms 702, 704 of 16 turns each. The spiral arms are supported by a substrate member 706 having a substantially planar support surface. As previously discussed, the substrate member 706 typically includes materials having a substantially insulating or semiconducting characteristic, and is backed by an absorbing device 710.

The spiral arms 702, 704 have respective original ends 712, 714 and terminal ends 716, 718. Between the respective original ends 712, 714 and terminal ends 716, 718, each spiral arm describes a generally polygonal spiral wherein radially adjacent loops of one arm are disposed substantially co-axial to one another about centerpoint 720. As previously noted, the loops on antenna 700 may be grouped according to polygonal configuration, e.g., groups 722 and 724.

Antenna 700 includes first 726 and second 728 exemplary interpolated loops between groups 722 and 724. In the context of antenna 700, the term interpolated indicates that the loops are modified at every last turn of each set of n-sided polygons. In the illustrated embodiment, each arm of the spiral antenna consists of 16 turns with 4 turns of n-sided polygons. Here, each 4 turns are such that instead of a regular n-sided polygon, the $4^{th}$ turn is an n-sided polygon interpolated from an n-sided to an (n−1)-sided polygon. The arrangement of the interpolated loops is more clearly seen in FIG. 7B which shows a geometric curve 730 corresponding to one arm of antenna 700. The curve includes a first group of loops 732 and a second group of loops at 734.

Viewing curve 730 along a radially outward orientation along the spiral, an exemplary transition point 736 is found where the curve continues along a linear segment 738 to vertex 740, rather than having a vertex at transition point 736. It should be noted that vertex 740 is not disposed at location 742, and that curve 730 therefore differs from exemplary curve 610 of FIG. 6. Instead, vertex 740 is disposed partway between transition point 736 and location 742. Consequently, the spiral does not immediately transition from an octagonal loop to a square loop, but forms a further irregular octagonal loop having sides, e.g. 744, 746, that differ in length.

In the illustrated curve 730, vertex 740 is disposed substantially halfway between transition point 736 and location 742. This location is particularly advantageous, although other intermediate locations are possible and fall within the scope of the invention. Because vertex 740 falls partway between transition point 736 and location 742, the loop 748 is referred to as an interpolated loop (i.e., between the loops of group 734 and the loops of group 732). As noted above, interpolated loops tend to improve the axial ratio performance of the antenna.

Characteristically, portions of the interpolated loop traverse what would otherwise be open gap between groups of loops, thus diminishing the size of such open gaps. The consequent smaller gaps, e.g. 750, 752, result in an antenna having improved complementarity.

While curve 730 has a single interpolated loop 748, it will be evident in light of the present disclosure that additional interpolated loops may be provided within the scope of the invention. An example of an antenna including additional interpolated loops is discussed below with respect to FIGS. 8A and 8B.

Figure 8A:
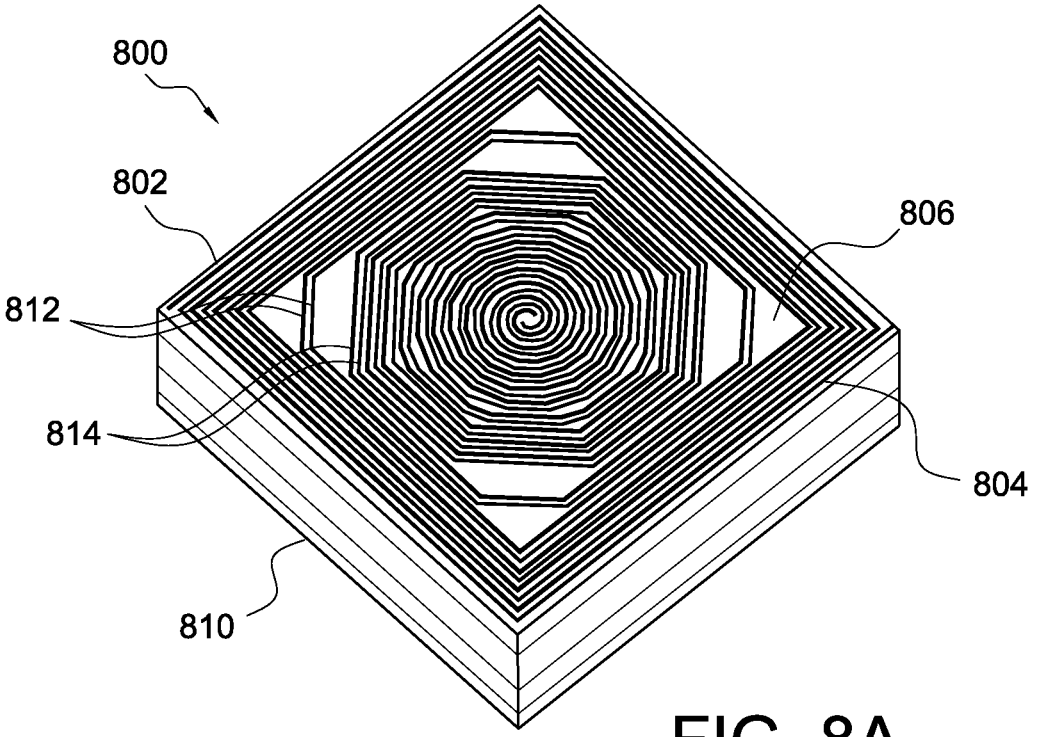
FIG. 8A shows, in schematic perspective view, a hybrid polygonal antenna device including an interpolated loop prepared according to principles of the invention.

FIG. 8A shows a further example of a polygonal spiral antenna 800 prepared according to principles of the invention, including extrapolated loops that moderate the effect of inter-group transitions. As illustrated, antenna 800 has two spiral arms 802, 804 of 16 turns each. The spiral arms are supported by a substrate member 806 having a substantially planar support surface. As previously discussed, the substrate member 806 typically includes materials having a substantially insulating or semiconducting characteristic, and is backed by an optional absorbing device 810.

The spiral arms of antenna 800 have first interpolated loops 812 and second interpolated loops 814. These interpolated loops are more clearly seen on FIG. 8B.

Figure 8B:
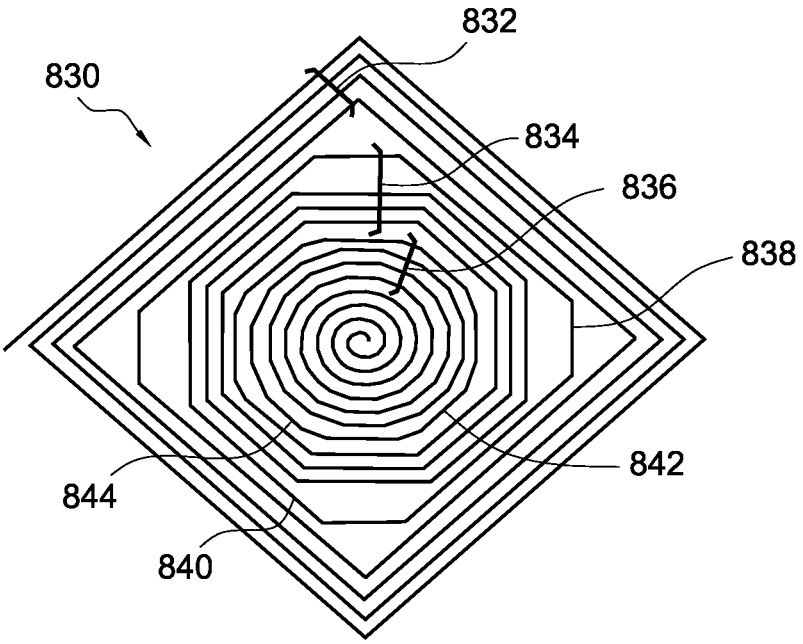
FIG. 8B shows a geometric spiral having characteristics associated with an antenna device including an interpolated loop prepared according to principles of the invention.

FIG. 8B shows a geometric curve 830 corresponding to one arm of antenna 800. The curve includes a first group of loops 832, a second group of loops 834, and a third group of loops 836. A first interpolated loop 838 includes a transition point 840 and is disposed between group 834 and group 832.

A second interpolated loop 842 includes a transition point 844 and is disposed between group 836 and group 834.

Figure 9A:
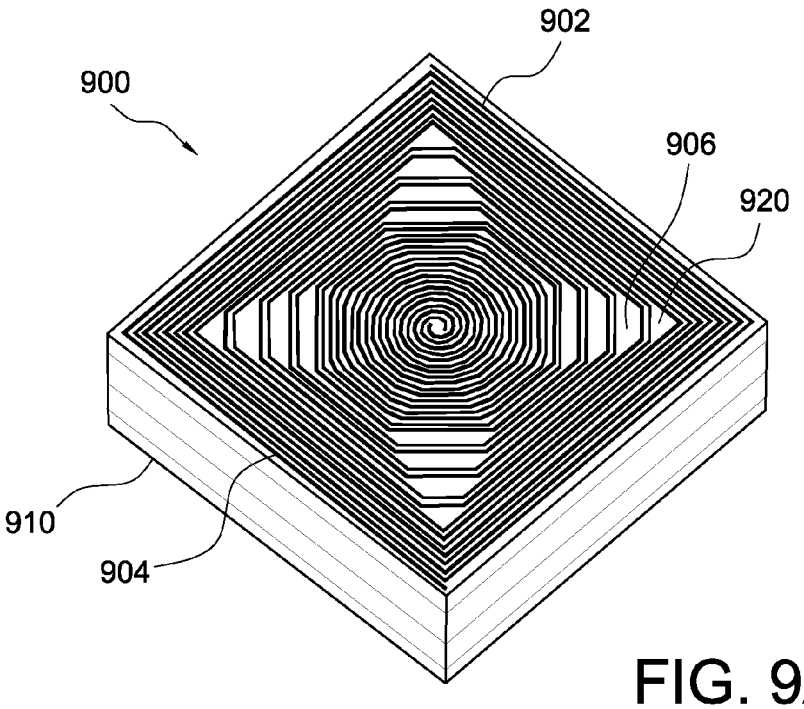
FIG. 9A shows, in schematic perspective view, a hybrid polygonal antenna device including an interpolated loop prepared according to principles of the invention.

As with antenna 700, each arm of antenna 800 has a single interpolated loop, e.g., 812 between adjacent groups. In light of the present disclosure, however, one of skill in the art will appreciate that other arrangements are possible and fall within the scope of the invention. Such arrangements may include, for example, multiple loops of similar interpolation, and/or loops exhibiting further interpolation. FIG. 9A shows one of many possible arrangements exemplifying this possibility.

FIG. 9A shows a further example of a polygonal spiral antenna 900 prepared according to principles of the invention, including extrapolated loops that moderate the effect of inter-group transitions. As illustrated, antenna 900 has two spiral arms 902, 904 of 16 turns each. The spiral arms are supported by a substrate member 906 having a substantially planar support surface. As previously discussed, the substrate member 906 typically includes materials having a substantially insulating or semiconducting characteristic, and is backed by an optional absorbing device 910.

Figure 9B:
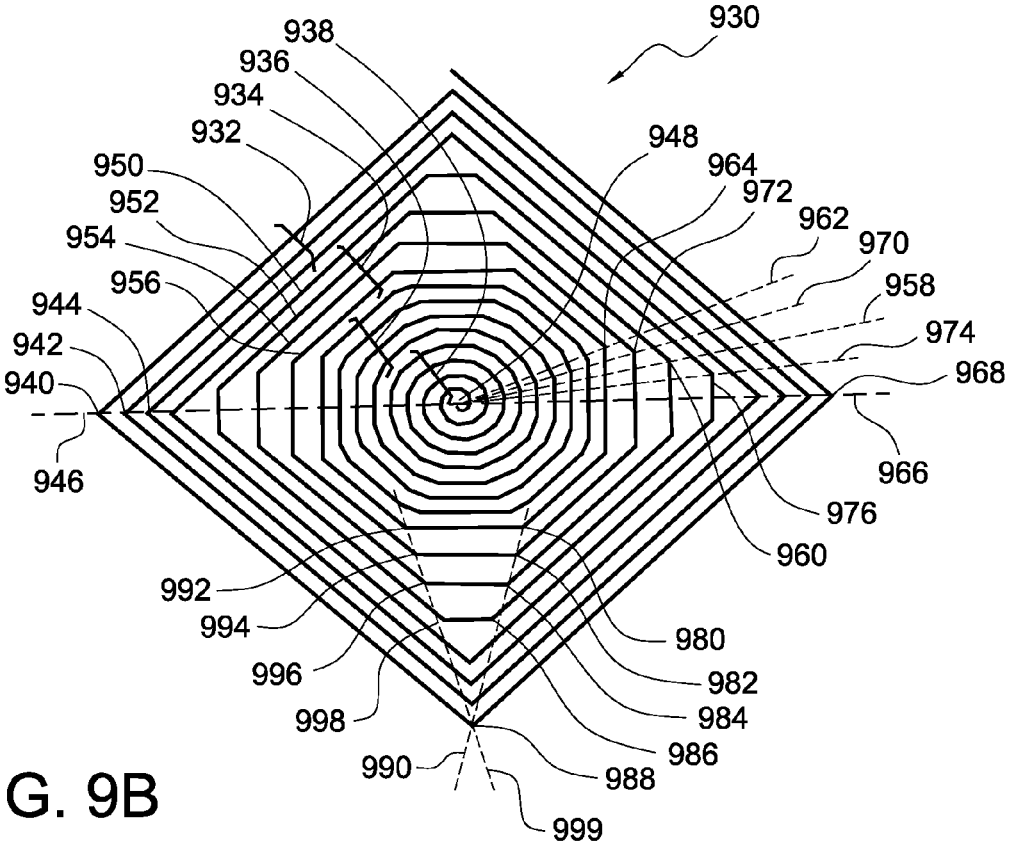
FIG. 9B shows a geometric spiral having characteristics associated with an antenna device including an interpolated loop prepared according to principles of the invention.

FIG. 9B shows a geometric curve 930 corresponding to one arm of antenna device 900. The curve includes a first group of loops 932, a second group of loops 934, a third group of loops 936, and a fourth group of loops 940. The loops of group 932 are non-interpolated square polygonal loops within the meaning of the present application. Consequently exemplary vertices 940, 942 and 944 are substantially radially aligned along an axis 946 through centerpoint 948.

In contrast, exemplary group 934 includes a plurality of loops 950, 952, 954 and 956 that are progressively interpolated between loop 956 and loop 950. This progressive interpolation corresponds to a ratio between a long side of the loop and a short side of the loop becoming progressively larger as one moves outward from loop to loop across the group. Correspondingly, a radial axis 958 through centerpoint 948 and vertex 960 of loop 952 is disposed at an angle halfway between radial axis 962, which intersects centerpoint 948 and vertex 964 of loop 956 and radial axis 966, which intersects centerpoint 948 and corner vertex 968. Similarly, radial axis 970 (through centerpoint 948 and vertex 972 of loop 954) is disposed at an angle bisecting the angle between radial axes 962 and 958. Likewise, radial axis 974 (through centerpoint 948 and vertex 976 of loop 950) is disposed at an angle bisecting the angle between radial axes 958 and 968.

Again, it should be noted that the substantially equal angular displacement between axes 962, 970, 958, 974 and 968 are merely exemplary of certain desirable embodiments, and alternative spacings and arrangements clearly fall within the scope of the invention. It also merits notice that each of exemplary vertices 980, 982, 984, 986 and 988 are substantially aligned 990 while each of exemplary vertices 992, 994, 996, 998 and 990 are also substantially aligned 999.

In antenna device 900, the loops of groups 936 and 938 are progressively interpolated, in the fashion described above with respect to group 934. The resulting polygonal curves of antenna 900 consequently change relatively smoothly from loop the loop and polygonal form to polygonal form between the original ends and terminal ends of each loop. As a further consequent of these smooth transitions the interstitial gaps e.g., 920 are relatively small as compared with the corresponding gap of an un-interpolated antenna (e.g., 344 of FIG. 3A).

In a further embodiment of the invention, an antenna device may include a combination of substantially polygonal loops and smoothly curved loops. That is, for example, substantially circular spiral loops would be provided inwardly of, and, e.g., in series connection with, the previously discussed substantially polygonal loops.

Having reviewed the foregoing disclosure, the practitioner of ordinary skill in the art will appreciate that the scope of the present invention is not limited to antenna devices having a square perimeter. Rather, the approaches and methods disclosed above suggest and allow a wide variety of combinations of polygonal forms in respective antennas according to the requirements and objectives of a particular application. Moreover, these approaches and methods allow for the combination of polygonal antennas according to the present invention in antenna arrays having new and beneficial arrangements.

Figure 10:
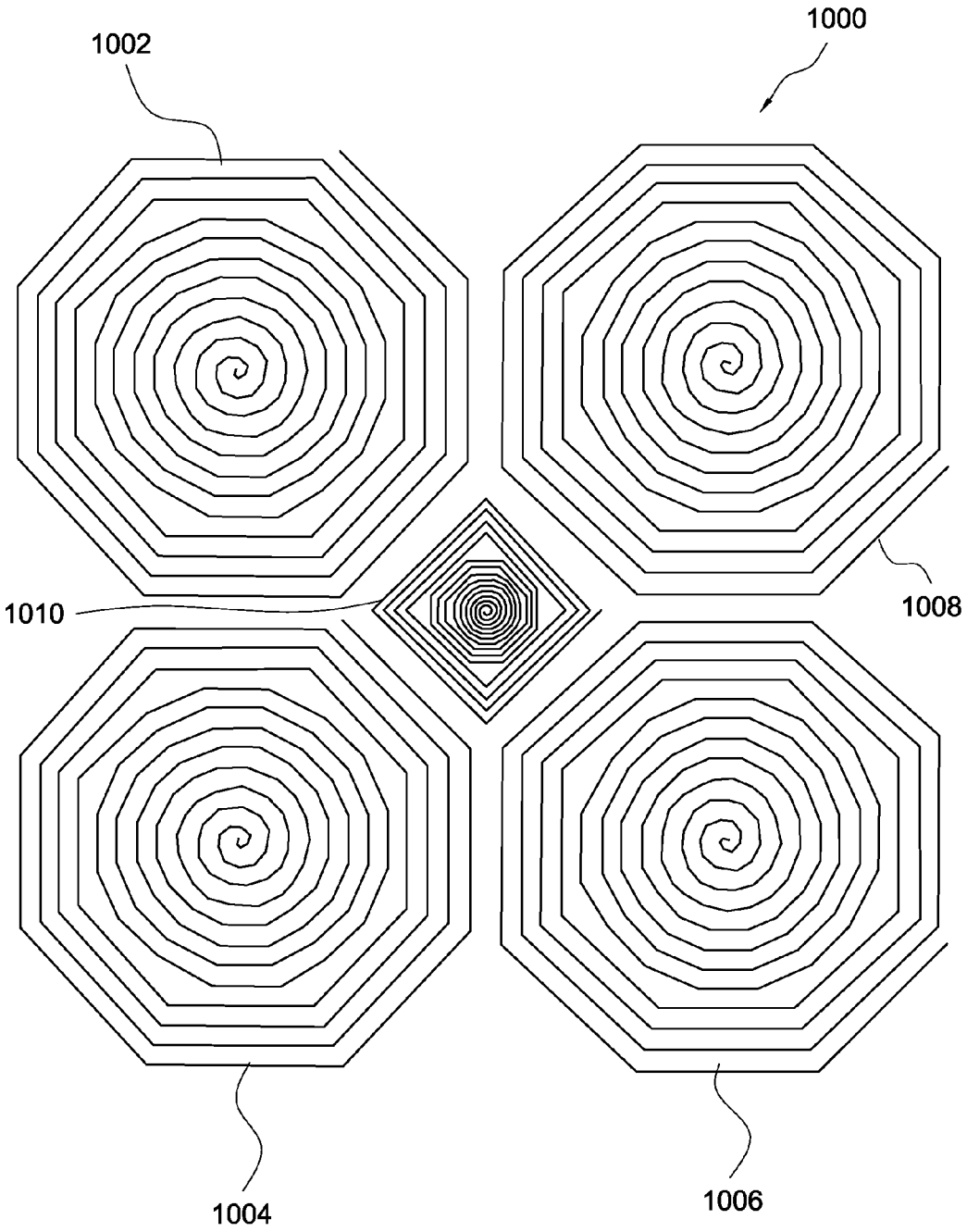
FIG. 10 shows several geometric spirals showing the arrangement of a portion of an antenna array including polygonal spirals according to principles of the invention.

FIG. 10 shows a plurality of curves representing a portion of one such array 1000 of antenna elements. Of course array 1000 is in tended to be exemplary of many other possibilities. As shown in FIG. 10, for example, a plurality of polygonal antenna members 1002, 1004, 1006, 1008, each having a substantially octagonal perimeter can be readily combined with a further antenna member 1010 having a substantially square perimeter to produce an antenna array having an efficient packing density. Likewise other geometries that would be understood given the benefit of the disclosure above, including geometries having different bases and exponents, are intended to fall within the ambit of the present disclosure.

Figure 11:
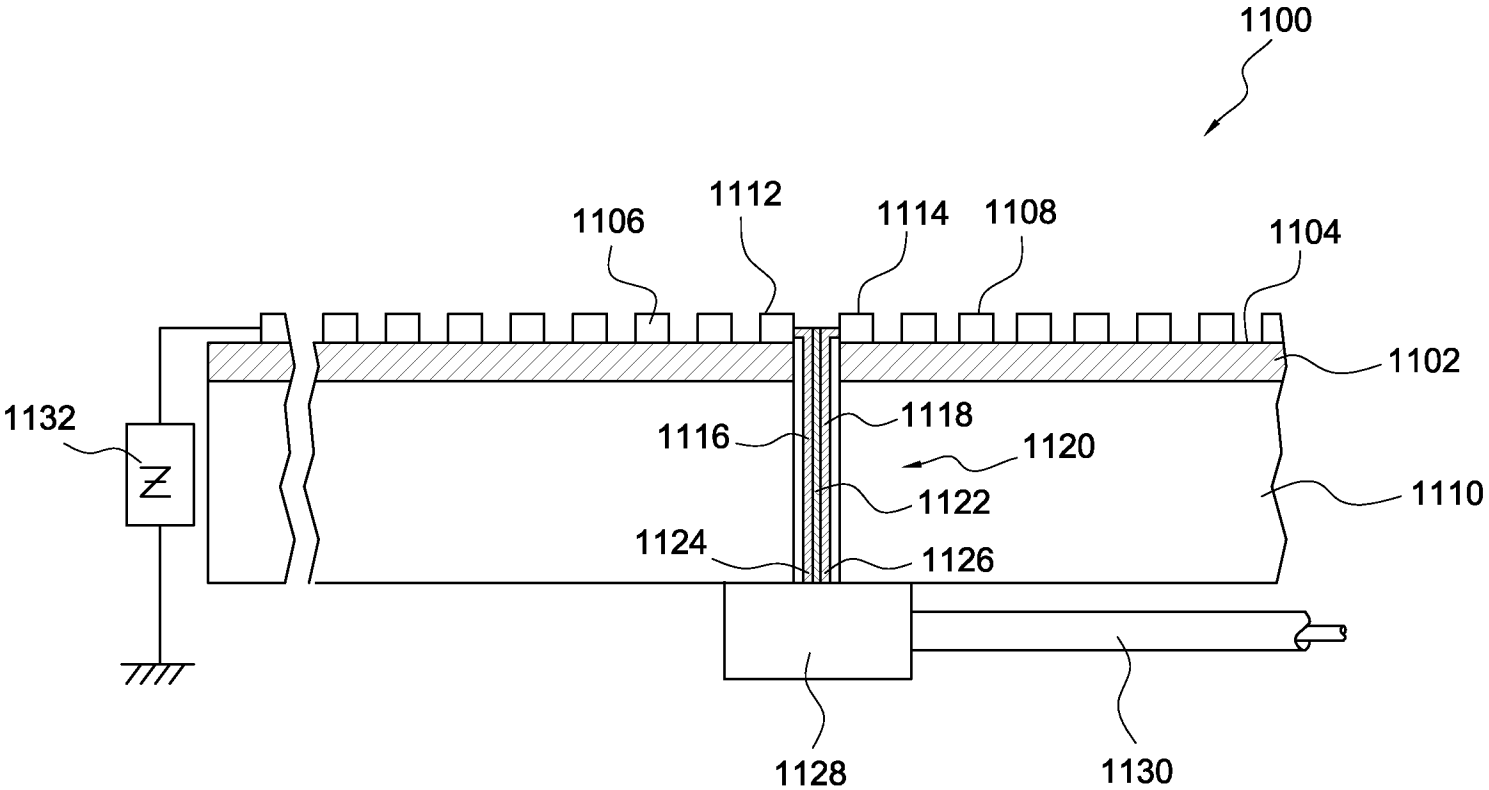
FIG. 11 shows a schematic cross-section of a portion of an antenna according to principals of the invention.

FIG. 11 shows, in schematic cross-section, a portion of a hybrid spiral antenna device 1100 according to principles of the invention. The antenna device 1100 includes a support member 1102. In the illustrated embodiment, for example, support member 1102 includes a substantially insulating ceramic material. A substantially planar upper surface 1104 of the support member supports first 1106 and second 1108 hybrid polygonal spiral arms according to principles of the invention. An absorbing device 1110, as previously discussed, is disposed adjacent to an opposite side of the support member 1102.

In the illustrated embodiment, the first and second hybrid polygonal spiral arms are adapted to be driven with a radiofrequency electrical signal at respective original ends 1112, 1114, thereof. Correspondingly, in the illustrated embodiment, original ends 1112 and 1114 are coupled to respective conductors 1116, 1118 of a coupling device 1120. In the illustrated embodiment, the coupling device is shown as a coaxial conducting device having a substantially insulating dielectric material 1122 disposed between the conductors 1116, 1118. It will be understood, however, that alternative conducting arrangements will be employed in other embodiments of the invention. For example substantially parallel strip lines and/or tapered line impedance transformers may be employed.

In the embodiment shown, conductors 1116, and 1118 are coupled at further ends 1124, 1126 to an impedance transformer 1128 which is, in turn, coupled to a further coaxial cable 1130. In the illustrated embodiment, the impedance transformer device serves to match an impedance of cable 1130 of approximately 50 ohms to an impedance of the antenna of approximately 188 ohms. In one embodiment, the impedance transformer device includes a balun device. In another embodiment of the invention, the impedance transformer includes a tapered line device.

The practitioner of ordinary skill in the art will be aware of a variety of manufacturing methods appropriate to the manufacturing of an antenna according to principles of the invention. For example, the antenna may be manufactured by providing an insulating substrate, such as, e.g., a ceramic substrate, having a generally planar upper surface. A layer of metallic material, such as copper, is deposited on the upper surface. A photoresist is deposited on an outer surface of the copper material. The photoresist layer is imaged and developed to provide a layer of the photoresist having a geometry corresponding to the desired antenna. An etching process removes excess copper material leaving behind the desired substantially polygonal spiral arms supported by the substrate.

Also shown is an exemplary terminating impedance 1132 coupled to a distal end of one of the substantially polygonal spiral arms. In still other embodiments of the invention, the antenna is driven by the application of a radiofrequency signal to respective distal ends of the antenna device.

Experimental Results

Gain

The full-wave analysis of the shallow cavity-backed modified Archimedean polygonal spiral antenna has been carried out with method-of-moments (MoM) based FEKO analysis. FEKO is a software product developed by EM Software & Systems—S.A. (Pty) Ltd. for the simulation of electromagnetic fields. The name is derived from a German acronym which can be translated as "Field Calculations for Bodies with Arbitrary Surface".

The initial simulations presented below assume matched conditions at the antenna input port. The excitation source impedance is defined to be 188Ω in accordance with Babinet-Booker's principle. Table 1, below, shows the boresight co-polarized Right Hand Circularly Polarized (RHCP) gain and the cross-polarized Left Hand Circularly Polarized (LHCP) gain for all frequency points at 1 GHz intervals for a 2-18 GHz antenna. The antenna demonstrates sufficiently high and stable gains, low side-lobes and no splits in the main beam across the bandwidth.

TABLE 1

Right-Hand Circular Polarization and Left-Hand Circular Polarization Gain (dB) at Boresight

| FREQ. | GAIN (dB) | |
|---|---|---|
| (GHz) | RHC | LHC |
| 2 | −1.94 | −16.4 |
| 3 | 0.80 | −18.6 |
| 4 | 3.29 | −12.4 |
| 5 | 4.51 | −10.1 |
| 6 | 5.08 | −9.9 |
| 7 | 6.07 | −20.9 |
| 8 | 6.49 | −17.5 |

TABLE 1-continued

Right-Hand Circular Polarization and Left-Hand Circular Polarization Gain (dB) at Boresight

| FREQ. | GAIN (dB) | |
|---|---|---|
| (GHz) | RHC | LHC |
| 9 | 6.27 | −25.8 |
| 10 | 5.75 | −28.8 |
| 11 | 5.77 | −23.9 |
| 12 | 5.58 | −20.0 |
| 13 | 5.24 | −22.1 |
| 14 | 5.51 | −28.0 |
| 15 | 4.92 | −24.3 |
| 16 | 5.05 | −35.0 |
| 17 | 5.26 | −42.5 |
| 18 | 5.41 | −30.7 |

Axial Ratio

Figure 12:
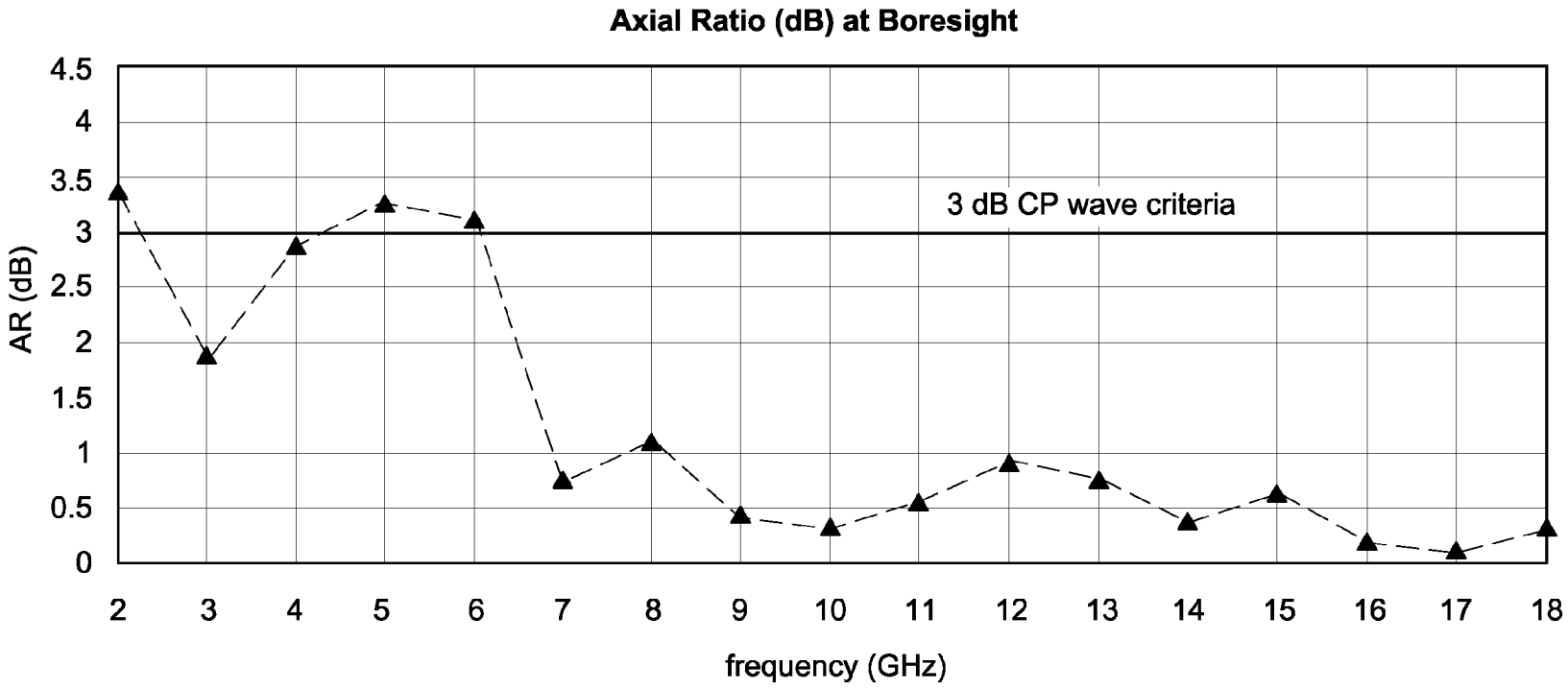
FIG. 12 shows a plot of axial ratio as a function of frequency representing simulated performance of an antenna prepared according to principles of the invention.

FIG. 12 shows a plot of axial ratio performance for a polygonal spiral antenna like that of FIG. 2. As is evident from FIG. 11, the axial ratio remains below 3 dB for 93.75% of the 2-18 GHz bandwidth. This performance represents a significant improvement over any previous Ultra-Wideband rectangular spiral antenna known to the inventors.

Voltage Standing Wave Ratio (VSWR)

Figure 13:
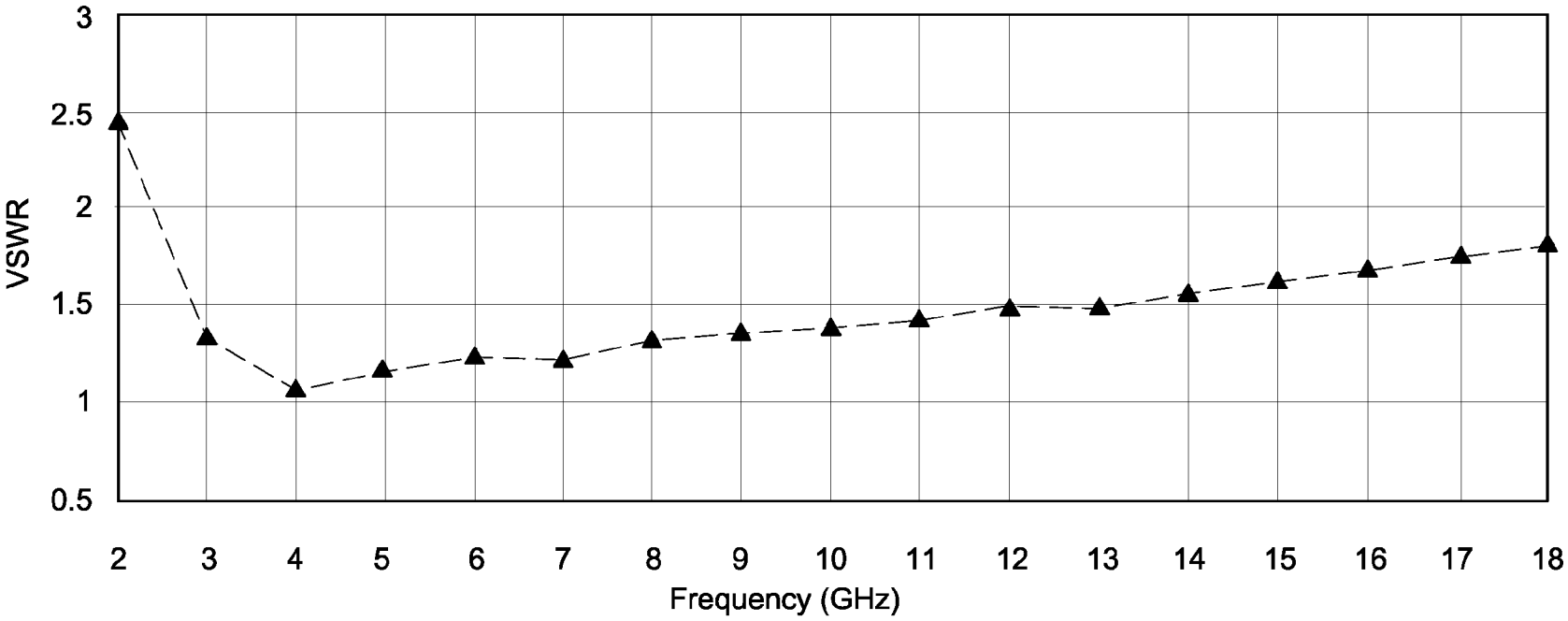
FIG. 13 shows a plot of VSWR as a function of frequency representing simulated performance of an antenna prepared according to principles of the invention.

FIG. 13 shows the VSWR performance for an exemplary optimized cavity-backed spiral antenna. The VSWR is referenced to 188 Ohms and is less than 2.5:1 for the entire bandwidth of operation. Similar characteristics could be anticipated from a well-designed antenna according to principles of the invention.

Input Impedance

Figure 14:
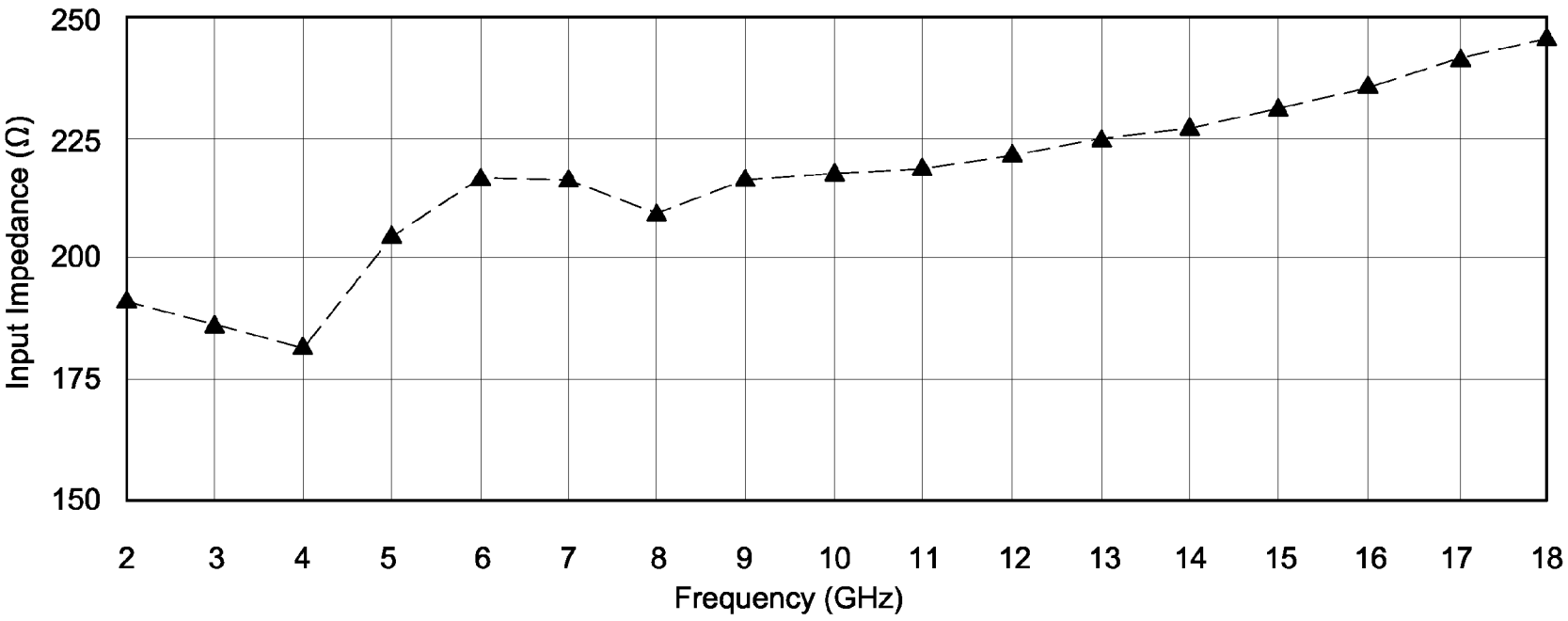
FIG. 14 shows a plot of input impedance as a function of frequency representing simulated performance of an antenna prepared according to principles of the invention.

FIG. 14 shows the input impedance to the cavity-backed Archimedean spiral antenna. The antenna realizes a near constant input impedance structure over an ultra-wide bandwidth. The input impedance is sensitive to small geometrical variations and slight deviations from mean input impedance of 215Ω can be attributed to the polygonal structure of the antenna which is not exactly self-complementary at the transition points from $2^n$ to $2^{n-1}$ sides.

S11

Figure 15:
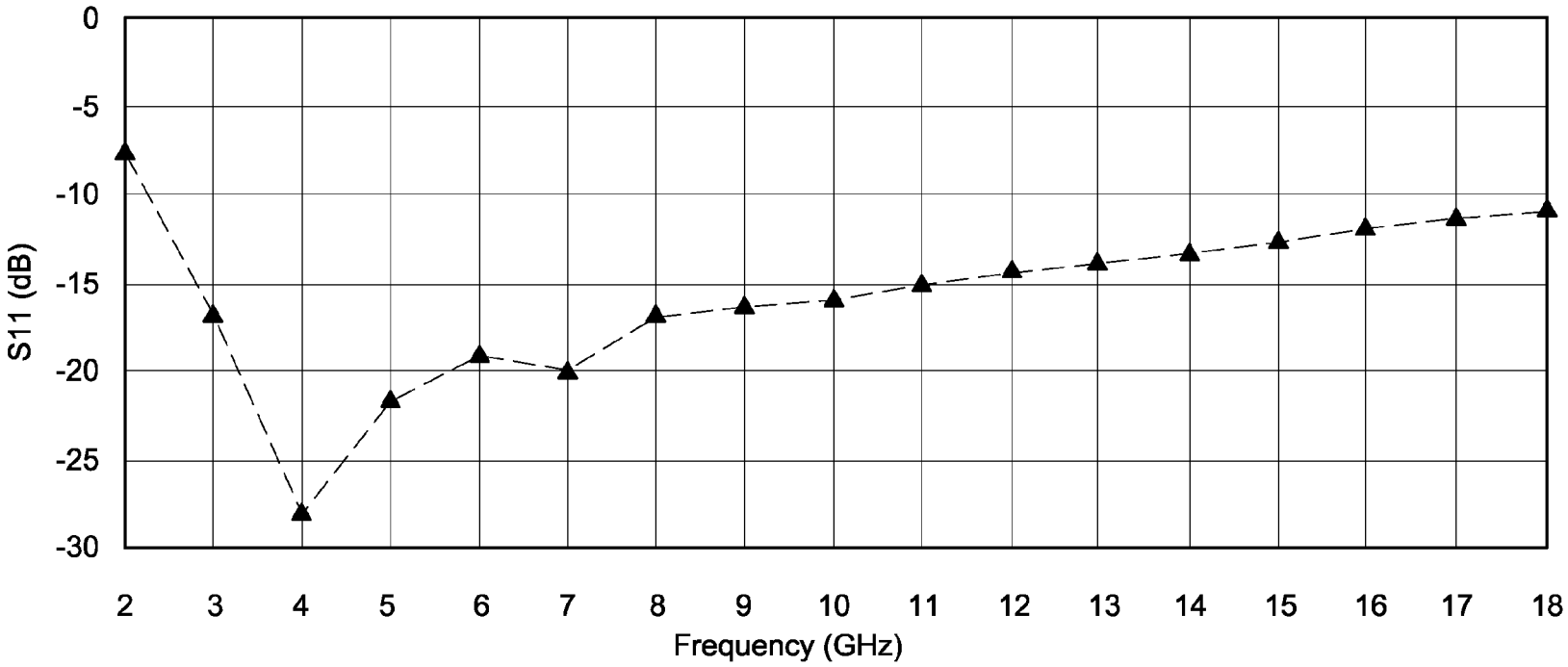
FIG. 15 shows a plot of S11 as a function of frequency representing simulated performance of an antenna prepared according to principles of the invention.

FIG. 15 shows the reflection coefficient at the antenna input port assuming matched conditions for the simulated antenna. The results show that the reflection coefficient is efficiently minimized to adequate levels across the bandwidth.

Performance Comparison of Polygonal Spiral with Circular and Square Spiral

A comparison of the radiation performance of a two-inch diameter shallow cavity-backed polygonal spiral antenna with two-inch circular spiral and a two-inch square spiral antenna. The results show that the polygonal antenna offers a significantly improved axial ratio characteristic while maintaining a gain-bandwidth performance substantially equivalent to either of a circular spiral and a square spiral. Table 2 illustrates a performance comparison between a polygonal spiral and a circular spiral from 2-18 GHz at 1 GHz intervals. Table 3 illustrates a performance comparison between a polygonal spiral and a square spiral from 2-18 GHz at 2 GHz intervals. It is evident that circular spirals operate with better axial ratio than square counterparts, and for equal diameters, the polygonal spiral has the best axial ratio performance of the three configurations.

TABLE 2

Boresight RHC and Gain, Axial Ratio, S11, VSWR, and Impedance Comparison of Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.22 | −1.94 | −7.26 | −16.4 | 11.00 | 3.33 | −6.73 | −7.45 | 2.71 | 2.47 | 70.3 | 191 |
| 3 | 1.22 | 0.80 | −12.7 | −18.6 | −3.57 | 1.88 | −13.9 | −16.6 | 1.50 | 1.34 | 128 | 187 |
| 4 | 3.84 | 3.29 | −8.53 | −12.4 | 4.26 | 2.89 | −13.9 | −27.9 | 1.50 | 1.08 | 127 | 182 |
| 5 | 5.56 | 4.51 | −7.02 | −10.1 | 4.16 | 3.28 | −12.1 | −21.7 | 1.65 | 1.18 | 115 | 205 |
| 6 | 6.37 | 5.08 | −19.8 | −9.9 | 0.86 | 3.13 | −13.7 | −19.0 | 1.52 | 1.25 | 124 | 217 |
| 7 | 6.58 | 6.07 | −32.5 | −20.9 | 0.19 | 0.78 | −13.2 | −19.8 | 1.56 | 1.23 | 121 | 217 |
| 8 | 6.52 | 6.49 | −36.0 | −17.5 | 0.13 | 1.10 | −13.9 | −16.8 | 1.50 | 1.34 | 125 | 210 |
| 9 | 6.04 | 6.27 | −40.9 | −25.8 | 0.08 | 0.44 | −14.2 | −16.1 | 1.48 | 1.37 | 127 | 217 |
| 10 | 5.24 | 5.75 | −52.3 | −28.8 | 0.02 | 0.33 | −12.6 | −15.6 | 1.61 | 1.40 | 117 | 218 |
| 11 | 4.09 | 5.77 | −49.2 | −23.9 | 0.04 | 0.57 | −9.08 | −14.9 | 2.08 | 1.44 | 91.7 | 219 |
| 12 | 4.01 | 5.58 | −50.2 | −20.0 | 0.03 | 0.91 | −9.81 | −14.2 | 1.95 | 1.49 | 97 | 222 |
| 13 | 4.55 | 5.24 | −54.5 | −22.1 | 0.02 | 0.75 | −10.1 | −13.7 | 1.90 | 1.52 | 101 | 224 |
| 14 | 4.96 | 5.51 | −48.8 | −28.0 | 0.04 | 0.37 | −10.6 | −13.0 | 1.83 | 1.58 | 105 | 227 |
| 15 | 5.15 | 4.92 | −53.3 | −24.3 | 0.02 | 0.60 | −11.0 | −12.4 | 1.79 | 1.63 | 106 | 231 |
| 16 | 5.46 | 5.05 | −57.0 | −35.0 | 0.01 | 0.17 | −11.6 | −11.8 | 1.72 | 1.69 | 110 | 236 |
| 17 | 5.58 | 5.26 | −86.5 | −42.5 | 0.00 | 0.07 | −11.8 | −11.2 | 1.69 | 1.76 | 111 | 241 |
| 18 | 5.66 | 5.41 | −64.9 | −30.7 | 0.01 | 0.27 | −12.5 | −10.8 | 1.62 | 1.81 | 117 | 246 |

TABLE 3

Boresight RHC and LHC Gain, Axial Ratio, S11, VSWR, and Impedance Comparison of a Polygonal and Square Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Sqr. | Poly. | Sqr. | Poly. | Sqr. | Poly. | Sqr. | Poly. | Sqr. | Poly. | Sqr. | Poly. |
| 2 | −1.54 | −1.94 | −18.1 | −16.4 | 2.59 | 3.33 | −28.1 | −7.45 | 1.08 | 2.47 | 201 | 191 |
| 4 | 3.23 | 3.29 | −13.3 | −12.4 | 2.6 | 2.89 | −25.8 | −27.9 | 1.11 | 1.08 | 208 | 182 |
| 6 | 5.53 | 5.08 | −8.97 | −9.9 | 3.31 | 3.13 | −28.4 | −19.0 | 1.08 | 1.25 | 203 | 217 |
| 8 | 6.23 | 6.49 | −5.11 | −17.5 | 4.83 | 1.10 | −22.6 | −16.8 | 1.16 | 1.34 | 204 | 210 |
| 10 | 5.51 | 5.75 | −5.63 | −28.8 | 4.95 | 0.33 | −23.9 | −15.6 | 1.14 | 1.40 | 211 | 218 |
| 12 | 4.19 | 5.58 | −5.36 | −20.0 | 6.01 | 0.91 | −24.9 | −14.2 | 1.12 | 1.49 | 207 | 222 |
| 14 | 5.05 | 5.51 | −4.73 | −28.0 | 5.85 | 0.37 | −21 | −13.0 | 1.20 | 1.58 | 214 | 227 |
| 16 | 5.84 | 5.05 | −3.86 | −35.0 | 5.9 | 0.17 | −18.9 | −11.8 | 1.26 | 1.69 | 219 | 236 |
| 18 | 4.82 | 5.41 | −7.04 | −30.7 | 4.53 | 0.27 | −18 | −10.8 | 1.29 | 1.81 | 221 | 246 |

Performance Analysis of Polygonal Spiral at Lower Frequencies

To verify the axial ratio performance of the polygonal spiral antenna at lower frequencies, the inventors simulated the model from 2-4 GHz at 100 MHz intervals and compared the axial ratio to that of a circular spiral. Table 4 illustrates a performance comparison between a polygonal spiral and a circular spiral from 2-4 GHz at 0.1 GHz intervals. The polygonal spiral shows greater than 3 dB axial ratio at frequency interval 2.0-2.4 GHz and in the vicinity of 3.3 GHz. The reason for the axial ratio degradation at particular discrete frequencies can be best understood from a heuristic approach and explained in terms of the current band theory.

TABLE 4

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.220 | −1.96 | −7.26 | −16.5 | 11.00 | 3.29 | −6.73 | −7.42 | 2.71 | 2.48 | 70.3 | 192 |
| 2.1 | −0.867 | −1.19 | −9.35 | −13.9 | 6.88 | 4.10 | −10.8 | −13.8 | 1.81 | 1.51 | 109 | 270 |
| 2.2 | −0.261 | −1.04 | −12.0 | −13.4 | 4.61 | 4.29 | −13.5 | −18.0 | 1.53 | 1.29 | 125 | 238 |

TABLE 4-continued

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2.3 | 0.001 | −1.57 | −14.1 | −11.6 | 3.48 | 5.68 | −14.5 | −11.0 | 1.46 | 1.78 | 129 | 314 |
| 2.4 | 0.109 | −0.60 | −14.9 | −14.3 | 3.11 | 3.63 | −15.1 | −16.4 | 1.43 | 1.36 | 132 | 139 |
| 2.5 | 0.152 | −0.52 | −14.9 | −14.5 | 3.11 | 3.51 | −15.0 | −11.5 | 1.43 | 1.73 | 132 | 189 |
| 2.6 | 0.277 | −0.203 | −14.4 | −18.9 | 3.25 | 2.02 | −13.9 | −13.5 | 1.50 | 1.53 | 126 | 264 |
| 2.7 | 0.571 | 0.025 | −13.6 | −19.1 | 3.46 | 1.92 | −12.8 | −15.6 | 1.60 | 1.40 | 118 | 261 |
| 2.8 | 0.843 | 0.229 | −13.0 | −19.8 | 3.59 | 1.73 | −12.4 | −17.3 | 1.63 | 1.31 | 115 | 210 |
| 2.9 | 0.985 | 0.581 | −12.8 | −20.0 | 3.61 | 1.63 | −12.7 | −20.9 | 1.60 | 1.20 | 118 | 157 |
| 3.0 | 1.220 | 0.756 | −12.7 | −18.8 | 3.56 | 1.84 | −14.1 | −17.2 | 1.49 | 1.32 | 127 | 189 |
| 3.1 | 1.680 | 0.961 | −11.8 | −16.2 | 3.73 | 2.41 | −15.7 | −16.4 | 1.39 | 1.36 | 135 | 240 |
| 3.2 | 1.99 | 1.25 | −11.0 | −16.8 | 3.98 | 2.19 | −15.8 | −17.4 | 1.39 | 1.31 | 136 | 246 |
| 3.3 | 2.04 | 1.31 | −10.8 | −11.9 | 4.01 | 3.87 | −14.0 | −20.9 | 1.50 | 1.20 | 128 | 194 |
| 3.4 | 2.27 | 1.67 | −10.8 | −14.1 | 3.91 | 2.86 | −12.5 | −21.7 | 1.62 | 1.18 | 117 | 164 |
| 3.5 | 2.64 | 1.86 | −10.0 | −17.3 | 4.12 | 1.92 | −12.0 | −21.2 | 1.67 | 1.19 | 113 | 191 |
| 3.6 | 2.82 | 2.23 | −9.48 | −13.8 | 4.30 | 2.76 | −12.5 | −22.1 | 1.63 | 1.17 | 116 | 202 |
| 3.7 | 3.12 | 2.48 | −9.50 | −14.7 | 4.14 | 2.42 | −14.3 | −19.5 | 1.48 | 1.24 | 130 | 219 |
| 3.8 | 3.56 | 2.72 | −8.93 | −17.3 | 4.20 | 1.74 | −15.4 | −23.3 | 1.41 | 1.19 | 135 | 208 |
| 3.9 | 3.72 | 2.95 | −8.33 | −14.4 | 4.43 | 2.36 | −15.1 | −21.6 | 1.42 | 1.44 | 132 | 201 |
| 4.0 | 3.79 | 3.17 | −8.56 | −12.6 | 4.27 | 2.88 | −13.0 | −23.4 | 1.58 | 1.15 | 119 | 192 |

Analysis of Axial Ratio Performance of Polygonal Spiral Antenna

A performance simulation based on characteristics identified with an antenna embodying principles of the invention suggests that such an antenna would have an axial ratio above about 3 dB at discrete frequencies 2.1-2.5 GHz and at 3.3 GHz. This phenomenon can be attributed to the fact that the current wavelengths corresponding to these frequencies are located at the transition points of the polygonal geometry.

Figure 16:
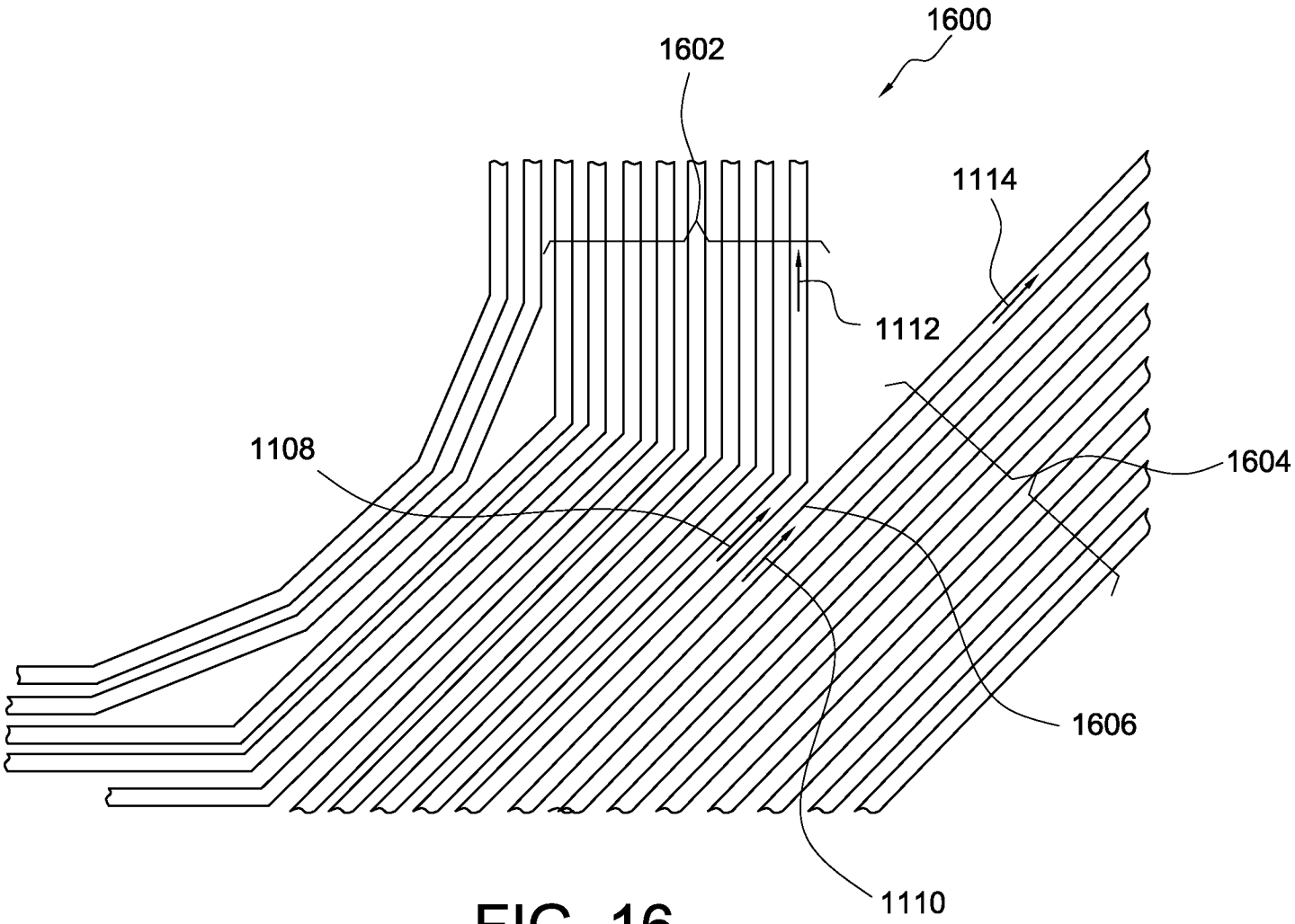
FIG. 16 shows a schematic representation of in-phase and out-of-phase current regions representing simulated performance of an antenna prepared according to principles of the invention.

FIG. 16 illustrates, in graphical schematic form, the results of a simulation indicating current distributions in adjacent arms when the antenna is operating at 2.3 GHz. Specifically, FIG. 16 shows a portion of a polygonal spiral antenna 1600. Antenna 1600 includes a first group of loops 1602 and a second group of loops, 1604 and a transition point 1606. In a region inward of the transition point, which is to say relatively circumferentially proximate to a driven end of the antenna (e.g., original ends of the antenna arms), first 1108 and second 1110 currents are in phase. Conversely, in a region outward of the transition point 1606, corresponding currents are out of phase, 1112, 1114.

Polygonal Spiral Antenna with 12$^{th}$ Interpolated Turn

Figure 7B:
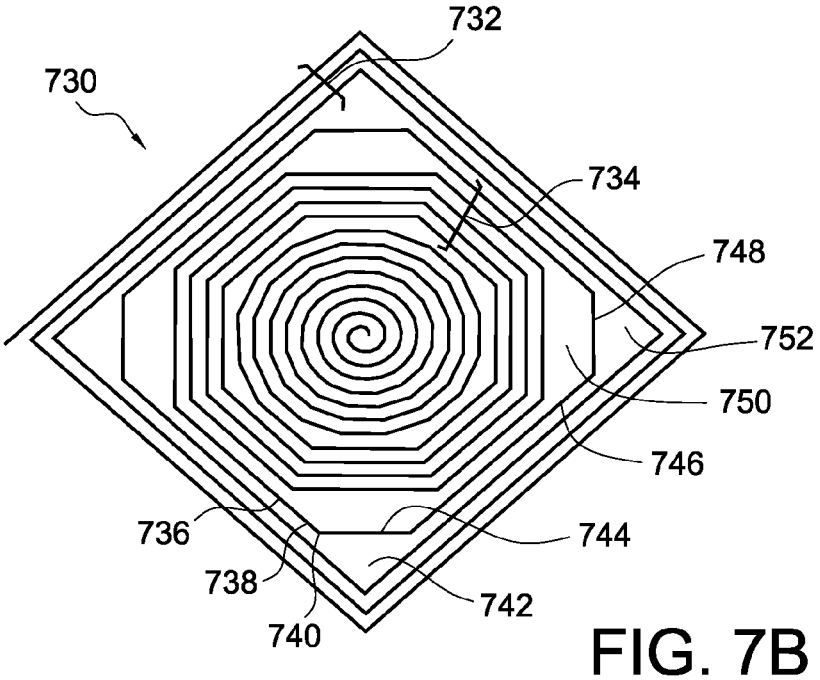
FIG. 7B shows a geometric spiral having characteristics associated with an antenna device prepared according to principles of the invention.

Further simulation results suggest that axial ratios above 3 dB may be anticipated at discrete frequencies 2.1-2.5 GHz and at 3.3 GHz. This phenomenon can be attributed to the fact that the current wavelengths corresponding to these frequencies are located at the transition points of the polygonal geometry. A simulation was performed with respect to an antenna similar to that of FIG. 7A. In this simulation a 12th turn of the spiral is modified such that instead of a regular octagon, the spiral arm includes an octagon interpolated from an 8 sided to a 4 sided polygon. The purpose of this modification is to allow for a smoother transition and reduce the axial ratio at a 2.1-2.5 GHz range. The antenna model and the corresponding spiral curve are shown in FIGS. 7A and 7B respectively.

Performance Comparison of Polygonal Spiral with Circular Spiral

Table 5 illustrates a performance simulation comparing a polygonal spiral antenna according to principles of the invention and a circular spiral antenna over a frequency range from 2-18 GHz at 1 GHz intervals.

TABLE 5

Boresight RHC Gain, LHC Gain, Axial Ratio, S11, VSWR, and Impedance Comparison of a Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.22 | −1.46 | −7.26 | −14.0 | 11.00 | 4.16 | −6.73 | −11.735 | 2.71 | 1.70 | 70.3 | 288 |
| 3 | 1.22 | 0.77 | −12.7 | −16.1 | −3.57 | 2.51 | −13.9 | −21.942 | 1.50 | 1.18 | 128 | 193 |

TABLE 5-continued

Boresight RHC Gain, LHC Gain, Axial Ratio, S11, VSWR, and Impedance Comparison of a Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 4 | 3.84 | 2.97 | −8.53 | −13.6 | 4.26 | 2.59 | −13.9 | −18.579 | 1.50 | 2.06 | 127 | 233 |
| 5 | 5.56 | 4.35 | −7.02 | −18.7 | 4.16 | 1.22 | −12.1 | −20.362 | 1.65 | 1.67 | 115 | 209 |
| 6 | 6.37 | 5.33 | −19.8 | −9.03 | 0.86 | 3.36 | −13.7 | −20.022 | 1.52 | 1.22 | 124 | 221 |
| 7 | 6.58 | 6.31 | −32.5 | −19.1 | 0.19 | 0.94 | −13.2 | −20.164 | 1.56 | 1.71 | 121 | 210 |
| 8 | 6.52 | 6.29 | −36.0 | −31.5 | 0.13 | 0.22 | −13.9 | −17.195 | 1.50 | 1.32 | 125 | 216 |
| 9 | 6.04 | 6.66 | −40.9 | −30.8 | 0.08 | 0.23 | −14.2 | −16.98 | 1.48 | 1.33 | 127 | 216 |
| 10 | 5.24 | 6.16 | −52.3 | −36.9 | 0.02 | 0.12 | −12.6 | −16.18 | 1.61 | 1.37 | 117 | 218 |
| 11 | 4.09 | 6.00 | −49.2 | −28.6 | 0.04 | 0.32 | −9.08 | −15.29 | 2.08 | 1.42 | 91.7 | 221 |
| 12 | 4.01 | 5.57 | −50.2 | −23.0 | 0.03 | 0.65 | −9.81 | −14.65 | 1.95 | 1.45 | 97 | 223 |
| 13 | 4.55 | 5.17 | −54.5 | −30.8 | 0.02 | 0.28 | −10.1 | −14.09 | 1.90 | 1.49 | 101 | 225 |
| 14 | 4.96 | 4.90 | −48.8 | −33.7 | 0.04 | 0.20 | −10.6 | −13.38 | 1.83 | 1.55 | 105 | 227 |
| 15 | 5.15 | 4.91 | −53.3 | −39.7 | 0.02 | 0.10 | −11.0 | −12.82 | 1.79 | 1.59 | 106 | 230 |
| 16 | 5.46 | 5.25 | −57.0 | −32.3 | 0.01 | 0.23 | −11.6 | −12.12 | 1.72 | 1.66 | 110 | 236 |
| 17 | 5.58 | 5.33 | −86.5 | −25.8 | 0.00 | 0.48 | −11.8 | −11.54 | 1.69 | 1.72 | 111 | 240 |
| 18 | 5.66 | 8.82 | −64.9 | −23.5 | 0.01 | 0.62 | −12.5 | −11.30 | 1.62 | 1.75 | 117 | 243 |

Performance Analysis of Polygonal Spiral at Lower Frequencies

To verify the axial ratio performance of the polygonal spiral antenna at lower frequencies, a model of an antenna according to principles of the invention was simulated over frequency ranges from 2-4 GHz and 5-7 GHz at 100 MHz intervals. Table 6 illustrates the performance comparison of a polygonal spiral and a circular spiral from 2-4 GHz at 0.1 GHz intervals. The polygonal spiral shows less than 3 dB axial ratio at frequency intervals of 2.0-2.23 GHz, 5.9-6.2 GHz and in the vicinity of 5.4 and 3.5 GHz.

TABLE 6

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.220 | −1.46 | −7.26 | −14.0 | 11.00 | 4.16 | −6.73 | −11.74 | 2.71 | 1.70 | 70.3 | 288 |
| 2.1 | −0.867 | −1.32 | −9.35 | −13.5 | 6.88 | 4.34 | −10.8 | −14.27 | 1.81 | 1.48 | 109 | 237 |
| 2.2 | −0.261 | −1.15 | −12.0 | −13.9 | 4.61 | 4.06 | −13.5 | −13.72 | 1.53 | 1.52 | 125 | 148 |
| 2.3 | 0.001 | −0.71 | −14.1 | −17.0 | 3.48 | 2.69 | −14.6 | −14.32 | 1.46 | 1.48 | 129 | 229 |
| 2.4 | 0.109 | −0.52 | −14.9 | −16.6 | 3.11 | 2.73 | −15.1 | −14.03 | 1.43 | 1.50 | 132 | 260 |
| 2.5 | 0.152 | −0.45 | −14.9 | −22.2 | 3.11 | 1.42 | −15.0 | −13.94 | 1.43 | 1.50 | 132 | 270 |
| 2.6 | 0.277 | −0.09 | −14.4 | −25.6 | 3.25 | 0.92 | −13.9 | −18.69 | 1.50 | 1.26 | 126 | 167 |
| 2.7 | 0.571 | 0.09 | −13.6 | −22.7 | 3.46 | 1.26 | −12.8 | −17.03 | 1.60 | 1.33 | 118 | 175 |
| 2.8 | 0.843 | 0.01 | −13.0 | −21.7 | 3.59 | 1.53 | −12.4 | −15.22 | 1.63 | 1.42 | 115 | 244 |
| 2.9 | 0.985 | 0.41 | −12.8 | −16.9 | 3.61 | 2.40 | −12.7 | −15.36 | 1.60 | 1.41 | 118 | 265 |
| 3.0 | 1.220 | 0.77 | −12.7 | −16.1 | 3.56 | 2.51 | −14.1 | −21.94 | 1.49 | 1.17 | 127 | 193 |
| 3.1 | 1.680 | 0.98 | −11.8 | −15.6 | 3.73 | 2.60 | −15.7 | −24.13 | 1.39 | 1.08 | 135 | 173 |
| 3.2 | 1.99 | 1.23 | −11.0 | −16.0 | 3.98 | 2.41 | −15.8 | −22.64 | 1.39 | 1.16 | 136 | 197 |
| 3.3 | 2.04 | 1.31 | −10.8 | −15.4 | 4.01 | 2.56 | −14.0 | −18.34 | 1.50 | 1.27 | 128 | 217 |
| 3.4 | 2.27 | 1.81 | −10.8 | −15.3 | 3.91 | 2.44 | −12.5 | −23.10 | 1.62 | 1.15 | 117 | 214 |
| 3.5 | 2.64 | 1.79 | −10.0 | −12.0 | 4.12 | 3.60 | −12.0 | −20.29 | 1.67 | 1.21 | 113 | 218 |
| 3.6 | 2.82 | 2.36 | −9.48 | −15.4 | 4.30 | 2.26 | −12.5 | −24.97 | 1.63 | 1.12 | 116 | 199 |
| 3.7 | 3.12 | 2.45 | −9.50 | −20.15 | 4.14 | 1.29 | −14.3 | −19.54 | 1.48 | 1.24 | 130 | 200 |
| 3.8 | 3.56 | 2.68 | −8.93 | −12.9 | 4.20 | 2.90 | −15.4 | −20.57 | 1.41 | 1.21 | 135 | 214 |
| 3.9 | 3.72 | 2.96 | −8.33 | −14.0 | 4.43 | 2.47 | −15.1 | −18.96 | 1.42 | 1.25 | 132 | 215 |
| 4.0 | 3.79 | 2.97 | −8.56 | −13.62 | 4.27 | 2.59 | −13.0 | −18.58 | 1.58 | 1.27 | 119 | 233 |
| 5.0 | 5.56 | 4.35 | −7.02 | −18.7 | 4.16 | 1.22 | −12.1 | −20.362 | 1.65 | 1.67 | 115 | 209 |
| 5.1 | 5.02 | 4.38 | −7.70 | −21.2 | 4.09 | 0.91 | −8.94 | −22.97 | 2.11 | 1.15 | 93 | 206 |
| 5.2 | 5.27 | 4.74 | −7.67 | −13.4 | 4.05 | 2.15 | −7.93 | −24.68 | 2.34 | 1.12 | 94 | 193 |
| 5.3 | 5.24 | 4.73 | −7.57 | −11.6 | 3.73 | 2.67 | −7.93 | −18.47 | 2.36 | 1.27 | 98 | 198 |
| 5.4 | 5.66 | 4.74 | −8.25 | −10.5 | 3.51 | 3.03 | −9.24 | −19.48 | 2.04 | 1.24 | 110 | 213 |

TABLE 6-continued

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 5.5 | 5.99 | 4.77 | −8.35 | −9.80 | 3.37 | 3.54 | −12.0 | −16.80 | 1.67 | 1.34 | 134 | 210 |
| 5.6 | 6.11 | 4.93 | −8.35 | −12.1 | 2.82 | 2.45 | −14.74 | −18.08 | 1.45 | 1.29 | 157 | 232 |
| 5.7 | 6.35 | 5.19 | −9.75 | −23.0 | 2.31 | 0.68 | −16.96 | −22.24 | 1.33 | 1.17 | 172 | 209 |
| 5.8 | 6.38 | 5.18 | −11.37 | −16.0 | 1.37 | 1.53 | −19.83 | −19.44 | 1.22 | 1.24 | 176 | 200 |
| 5.9 | 6.48 | 5.29 | −15.76 | −9.81 | 1.03 | 3.13 | −23.88 | −16.47 | 1.14 | 1.35 | 173 | 226 |
| 6.0 | 6.55 | 5.33 | −18.02 | −9.04 | 1.04 | 3.36 | −24.61 | −20.02 | 1.13 | 1.22 | 167 | 221 |
| 6.1 | 6.52 | 5.48 | −17.90 | −9.49 | 0.41 | 1.13 | −19.7 | −19.10 | 1.23 | 1.25 | 158 | 209 |
| 6.2 | 6.55 | 5.63 | −26.06 | −11.7 | 0.46 | 2.37 | −16.54 | −17.69 | 1.35 | 1.30 | 148 | 228 |
| 6.3 | 6.51 | 5.74 | −24.98 | −19.5 | 0.46 | 0.95 | −14.76 | −21.08 | 1.45 | 1.54 | 139 | 217 |
| 6.4 | 6.48 | 5.78 | −25.01 | −15.7 | 0.35 | 1.47 | −13.57 | −22.30 | 1.54 | 1.16 | 130 | 202 |
| 6.5 | 6.42 | 5.84 | −27.52 | −13.0 | 0.35 | 2.00 | −12.46 | −18.38 | 1.62 | 1.27 | 121 | 210 |
| 6.6 | 6.41 | 6.09 | −27.12 | −14.2 | 0.36 | 1.69 | −11.57 | −19.74 | 1.72 | 1.23 | 113 | 218 |
| 6.7 | 6.40 | 6.17 | −30.91 | −16.9 | 0.24 | 1.22 | −11.14 | −20.35 | 1.77 | 1.21 | 109 | 204 |
| 6.8 | 6.42 | 6.13 | −28.84 | −19.8 | 0.30 | 0.88 | −10.91 | −18.24 | 1.80 | 1.28 | 106 | 211 |
| 6.9 | 6.38 | 6.21 | −35.30 | −20.6 | 0.14 | 0.79 | −10.71 | −18.44 | 1.82 | 1.27 | 103 | 218 |
| 7.0 | 6.39 | 6.31 | −31.27 | −19.1 | 0.23 | 0.94 | −10.56 | −20.16 | 1.84 | 1.22 | 102 | 210 |

Performance Comparison of Polygonal Spiral with Circular Spiral

Table 7 illustrates a performance simulation comparing a polygonal spiral antenna according to principles of the invention and a circular spiral antenna over a frequency range from 2-18 GHz at 1 GHz intervals.

TABLE 7

Boresight RHC Gain, LHC Gain, Axial Ratio, S11, VSWR, and Impedance Comparison of a Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.22 | −2.12 | −7.26 | −15.2 | 11.00 | 3.90 | −6.73 | −7.47 | 2.71 | 2.47 | 70.3 | 334 |
| 3 | 1.22 | 0.81 | −12.7 | −18.4 | 3.56 | 1.91 | −14.1 | −16.35 | 1.49 | 2.66 | 127 | 194 |
| 4 | 3.79 | 3.30 | −8.56 | −18.0 | 4.27 | 1.50 | −13.0 | −22.67 | 1.58 | 1.16 | 119 | 213 |
| 5 | 5.47 | 4.41 | −6.94 | −9.34 | 4.05 | 3.62 | −11.4 | −29.55 | 1.54 | 1.07 | 125 | 190 |
| 6 | 6.55 | 5.30 | −18.02 | −11.2 | 1.04 | 2.62 | −24.61 | −18.66 | 1.13 | 1.26 | 167 | 183 |
| 7 | 6.58 | 6.18 | −32.5 | −12.7 | 0.19 | 1.98 | −13.2 | −18.08 | 1.56 | 1.29 | 121 | 202 |
| 8 | 6.52 | 6.22 | −36.0 | −20.8 | 0.13 | 0.77 | −13.9 | −16.90 | 1.50 | 1.33 | 125 | 211 |
| 9 | 6.04 | 6.16 | −40.9 | −24.7 | 0.08 | 0.50 | −14.2 | −16.28 | 1.48 | 1.36 | 127 | 211 |
| 10 | 5.24 | 6.27 | −52.3 | −21.1 | 0.02 | 0.74 | −12.6 | −15.19 | 1.61 | 1.42 | 117 | 213 |
| 11 | 4.09 | 5.70 | −49.2 | −24.3 | 0.04 | 0.55 | −9.08 | −14.50 | 2.08 | 1.46 | 91.7 | 218 |
| 12 | 4.01 | 5.61 | −50.2 | −26.1 | 0.03 | 0.45 | −9.81 | −13.88 | 1.95 | 1.51 | 97 | 220 |
| 13 | 4.55 | 5.40 | −54.5 | −21.3 | 0.02 | 0.81 | −10.1 | −13.20 | 1.90 | 1.56 | 101 | 224 |
| 14 | 4.96 | 4.91 | −48.8 | −26.4 | 0.04 | 0.46 | −10.6 | −12.59 | 1.83 | 1.61 | 105 | 226 |
| 15 | 5.15 | 4.77 | −53.3 | −40.3 | 0.02 | 0.10 | −11.0 | −11.88 | 1.79 | 1.68 | 106 | 231 |
| 16 | 5.46 | 4.98 | −57.0 | −31.3 | 0.01 | 0.27 | −11.6 | −11.31 | 1.72 | 1.75 | 110 | 236 |
| 17 | 5.58 | 5.18 | −86.5 | −26.3 | 0.00 | 0.46 | −11.8 | −10.79 | 1.69 | 1.81 | 111 | 242 |
| 18 | 5.66 | 5.28 | −64.9 | −31.5 | 0.01 | 0.25 | −12.5 | −10.33 | 1.62 | 1.88 | 117 | 247 |

Performance Analysis of Polygonal Spiral at Lower Frequencies

A further simulation was performed with respect to a polygonal spiral antenna at lower frequencies. This simulation modeled the subject device over a frequency range of 2-6 GHz at 100 MHz intervals. Table 8 illustrates a performance simulation comparing a polygonal spiral and a circular spiral over frequency range of 2-6 GHz at 0.1 GHz intervals. The simulation suggests polygonal spiral antenna performance with an axial ratio above 3 dB at frequency intervals 2.0-2.6 GHz, 4.8-5.1 GHz and in the vicinity of 3.8 GHz.

TABLE 8

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.22 | −2.12 | −7.26 | −15.2 | 11.00 | 3.90 | −6.73 | −7.47 | 2.71 | 2.47 | 70.3 | 334 |
| 2.1 | −0.87 | −2.17 | −9.35 | −15.5 | 6.88 | 3.83 | −10.8 | −7.44 | 1.81 | 2.48 | 109 | 352 |
| 2.2 | −0.26 | −0.92 | −12.0 | −14.0 | 4.61 | 3.93 | −13.5 | −23.83 | 1.53 | 1.12 | 125 | 213 |
| 2.3 | 0.00 | −0.62 | −14.1 | −14.0 | 3.48 | 3.79 | −14.5 | −17.44 | 1.46 | 2.10 | 129 | 149 |
| 2.4 | 0.11 | −0.72 | −14.9 | −16.6 | 3.11 | 2.82 | −15.1 | −13.11 | 1.43 | 1.57 | 132 | 209 |
| 2.5 | 0.15 | −0.65 | −14.9 | −14.6 | 3.11 | 3.52 | −15.0 | −13.18 | 1.43 | 1.56 | 132 | 292 |
| 2.6 | 0.28 | 0.01 | −14.4 | −21.9 | 3.25 | 1.73 | −13.9 | −24.63 | 1.50 | 1.17 | 126 | 213 |
| 2.7 | 0.57 | 0.20 | −13.6 | −18.2 | 3.46 | 2.09 | −12.8 | −24.63 | 1.60 | 1.12 | 118 | 211 |
| 2.8 | 0.84 | 0.35 | −13.0 | −21.5 | 3.59 | 1.40 | −12.4 | −27.66 | 1.63 | 1.09 | 115 | 180 |
| 2.9 | 0.99 | 0.65 | −12.8 | −31.0 | 3.61 | 0.46 | −12.7 | −20.80 | 1.60 | 1.20 | 118 | 166 |
| 3.0 | 1.22 | 0.81 | −12.7 | −18.4 | 3.56 | 1.91 | −14.1 | −16.35 | 1.49 | 2.66 | 127 | 194 |
| 3.1 | 1.68 | 0.98 | −11.8 | −17.0 | 3.73 | 2.21 | −15.7 | −16.85 | 1.39 | 1.34 | 135 | 228 |
| 3.2 | 1.99 | 1.27 | −11.0 | −16.0 | 3.98 | 2.41 | −15.8 | −17.99 | 1.39 | 1.29 | 136 | 239 |
| 3.3 | 2.04 | 1.53 | −10.8 | −14.6 | 4.01 | 2.74 | −14.0 | −24.56 | 1.50 | 1.13 | 128 | 207 |
| 3.4 | 2.27 | 1.76 | −10.8 | −14.5 | 3.91 | 2.69 | −12.5 | −24.17 | 1.62 | 1.13 | 117 | 173 |
| 3.5 | 2.64 | 2.03 | −10.0 | −14.6 | 4.12 | 2.58 | −12.0 | −19.30 | 1.67 | 1.24 | 113 | 192 |
| 3.6 | 2.82 | 2.31 | −9.48 | −15.0 | 4.30 | 2.39 | −12.5 | −19.45 | 1.63 | 1.24 | 116 | 195 |
| 3.7 | 3.12 | 2.41 | −9.50 | −16.0 | 4.14 | 2.09 | −14.3 | −17.01 | 1.48 | 1.33 | 130 | 217 |
| 3.8 | 3.56 | 2.77 | −8.93 | −10.6 | 4.20 | 3.77 | −15.4 | −21.60 | 1.41 | 1.18 | 135 | 204 |
| 3.9 | 3.72 | 2.92 | −8.33 | −13.7 | 4.43 | 2.59 | −15.1 | −21.80 | 1.42 | 1.42 | 132 | 208 |
| 4.0 | 3.79 | 3.30 | −8.56 | −18.0 | 4.27 | 1.50 | −13.0 | −22.67 | 1.58 | 1.16 | 119 | 213 |
| 4.1 | 3.75 | 3.45 | −8.26 | −12.5 | 4.27 | 2.80 | −11.7 | −25.72 | 1.74 | 1.11 | 109 | 194 |
| 4.2 | 3.94 | 3.66 | −8.41 | −12.4 | 4.24 | 2.78 | −14.1 | −19.90 | 1.70 | 1.22 | 111 | 213 |
| 4.3 | 4.43 | 3.88 | −7.97 | −13.2 | 4.44 | 2.46 | −15.6 | −22.23 | 1.49 | 1.17 | 127 | 211 |
| 4.4 | 4.62 | 3.88 | −7.41 | −13.2 | 4.29 | 2.46 | −12.9 | −22.23 | 1.40 | 1.17 | 135 | 211 |
| 4.5 | 4.62 | 4.16 | −7.70 | −17.9 | 4.21 | 1.38 | −11.2 | −18.84 | 1.59 | 1.26 | 122 | 225 |
| 4.6 | 4.81 | 4.10 | −7.67 | −13.1 | 4.37 | 2.42 | −11.4 | −25.57 | 1.76 | 1.11 | 108 | 200 |
| 4.7 | 4.94 | 4.34 | −7.23 | −13.5 | 4.22 | 2.24 | −13.4 | −21.74 | 1.74 | 1.18 | 108 | 215 |
| 4.8 | 5.14 | 4.38 | −7.32 | −10.7 | 4.13 | 3.10 | −15.1 | −25.35 | 1.54 | 1.11 | 123 | 195 |
| 4.9 | 5.48 | 4.22 | −7.17 | −9.18 | 4.24 | 3.77 | −13.4 | −22.14 | 1.42 | 1.17 | 132 | 210 |
| 5.0 | 5.47 | 4.41 | −6.94 | −9.34 | 4.05 | 3.62 | −11.4 | −29.55 | 1.54 | 1.07 | 125 | 190 |
| 5.1 | 5.02 | 4.40 | −7.70 | −8.94 | 4.09 | 3.80 | −8.94 | −19.49 | 2.11 | 1.24 | 111 | 191 |
| 5.2 | 5.27 | 4.54 | −7.67 | −11.2 | 4.05 | 2.87 | −7.93 | −18.85 | 2.34 | 1.99 | 94 | 215 |
| 5.3 | 5.24 | 4.75 | −7.57 | −12.3 | 3.73 | 2.46 | −7.93 | −23.77 | 2.36 | 1.14 | 98 | 200 |
| 5.4 | 5.66 | 4.84 | −8.25 | −10.9 | 3.51 | 2.85 | −9.24 | −22.03 | 2.04 | 1.17 | 110 | 206 |
| 5.5 | 5.99 | 4.87 | −8.35 | −10.5 | 3.37 | 2.99 | −12.0 | −23.73 | 1.67 | 1.14 | 134 | 184 |
| 5.6 | 6.11 | 4.87 | −8.35 | −11.4 | 2.82 | 2.68 | −14.74 | −17.46 | 1.45 | 1.31 | 157 | 191 |
| 5.7 | 6.35 | 4.95 | −9.75 | −13.1 | 2.31 | 2.17 | −16.96 | −17.15 | 1.33 | 1.32 | 172 | 217 |
| 5.8 | 6.38 | 5.18 | −11.37 | −29.8 | 1.37 | 0.31 | −19.83 | −32.23 | 1.22 | 1.22 | 176 | 213 |
| 5.9 | 6.48 | 5.30 | −15.76 | −15.0 | 1.03 | 1.68 | −23.88 | −24.09 | 1.14 | 1.13 | 173 | 196 |
| 6.0 | 6.55 | 5.30 | −18.02 | −11.2 | 1.04 | 2.62 | −24.61 | −18.66 | 1.13 | 1.26 | 167 | 183 |

Polygonal Spiral Antenna with Gradually Transitioning Arms

A further simulation was performed with respect to a polygonal spiral antenna with gradually transitioning arms. In this model of the polygonal spiral antenna, each arm of the spiral antenna consists of 16 turns with sets of 4 turns of n-sided polygons. However, each 4 turns are such that the first turn is a regular n-sided polygon with n-equal sides, then the consecutive turns are n-sided polygons gradually transitioning from an n-sided to an (n−1)-sided polygon. The simulated antenna is similar to that of FIGS. 9A and 9B.

Performance Comparison of Polygonal Spiral with Circular Spiral

Table 9 illustrates a performance comparison between a polygonal spiral and a circular spiral over a frequency range from about 2-18 GHz at 1 GHz intervals.

TABLE 9

Boresight RHC Gain, LHC Gain, Axial Ratio, S11, VSWR, and Impedance Comparison of a Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.220 | −1.49 | −7.26 | −16.9 | 11.00 | 2.97 | −6.73 | −13.87 | 2.71 | 1.51 | 70.3 | 152 |
| 3 | 1.220 | 0.83 | −12.7 | −16.8 | 3.56 | 2.29 | −14.1 | −21.85 | 1.49 | 1.18 | 127 | 221 |

TABLE 9-continued

Boresight RHC Gain, LHC Gain, Axial Ratio, S11, VSWR, and Impedance Comparison of a Polygonal and Circular Spiral Antenna

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 4 | 3.79 | 3.21 | −8.56 | −13.9 | 4.27 | 2.44 | −13.0 | −22.63 | 1.58 | 1.16 | 119 | 211 |
| 5 | 5.47 | 4.28 | −6.94 | −8.4 | 4.05 | 4.12 | −11.4 | −17.40 | 1.54 | 1.31 | 125 | 199 |
| 6 | 6.55 | 5.26 | −18.02 | −13.2 | 1.04 | 2.09 | −24.61 | −16.17 | 1.13 | 1.37 | 167 | 209 |
| 7 | 6.58 | 6.01 | −32.5 | −10.6 | 0.19 | 2.59 | −13.2 | −16.18 | 1.36 | 1.37 | 121 | 205 |
| 8 | 6.52 | 6.19 | −36.0 | −12.3 | 0.13 | 2.08 | −13.9 | −14.52 | 1.50 | 1.46 | 125 | 228 |
| 9 | 6.04 | 6.02 | −40.9 | −21.3 | 0.08 | 0.75 | −14.2 | −14.32 | 1.48 | 1.48 | 127 | 220 |
| 10 | 5.24 | 5.94 | −52.3 | −21.2 | 0.02 | 0.77 | −12.6 | −14.19 | 1.61 | 1.48 | 117 | 221 |
| 11 | 4.09 | 5.93 | −49.2 | −26.1 | 0.04 | 0.44 | −9.08 | −13.24 | 2.08 | 1.56 | 91.7 | 224 |
| 12 | 4.01 | 5.44 | −50.2 | −22.8 | 0.03 | 0.68 | −9.81 | −12.65 | 1.95 | 1.60 | 97 | 226 |
| 13 | 4.55 | 5.17 | −54.5 | −37.3 | 0.02 | 0.13 | −10.1 | −11.84 | 1.90 | 1.69 | 101 | 232 |
| 14 | 4.96 | 4.89 | −48.8 | −19.5 | 0.04 | 1.05 | −10.6 | −11.30 | 1.83 | 1.75 | 105 | 236 |
| 15 | 5.15 | 4.89 | −53.3 | −37.6 | 0.02 | 0.13 | −11.0 | −10.63 | 1.79 | 1.83 | 106 | 243 |
| 16 | 5.46 | 4.81 | −57.0 | −26.4 | 0.01 | 0.48 | −11.6 | −10.03 | 1.72 | 1.92 | 110 | 249 |
| 17 | 5.58 | 4.96 | −86.5 | −28.1 | 0.00 | 0.39 | −11.8 | −9.55 | 1.69 | 2.00 | 111 | 257 |
| 18 | 5.66 | 3.15 | −64.9 | −28.6 | 0.01 | 0.36 | −12.5 | −9.14 | 1.62 | 2.07 | 117 | 264 |

Performance Analysis of Polygonal Spiral at Lower Frequencies

To verify the axial ratio performance of the polygonal spiral antenna at lower frequencies, a further simulation was performed representing an antenna having characteristics according to the invention. This simulation was performed over a frequency range from about 2-6 GHz at 100 MHz intervals. Table 10 illustrates a simulated performance comparison between a polygonal spiral antenna and a circular spiral over a frequency range from about 2-6 GHz at 0.1 GHz intervals. The results of the simulation suggest a polygonal spiral having an axial ratio above 3 dB at frequency intervals from about 4.9-5.0 GHz, 5.3-5.7 GHz, and in the vicinity of 2.1 GHz.

TABLE 10

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 2 | −2.220 | −1.49 | −7.26 | −16.9 | 11.00 | 2.97 | −6.73 | −13.87 | 2.71 | 1.51 | 70.3 | 152 |
| 2.1 | −0.867 | −1.47 | −9.35 | −16.6 | 6.88 | 3.09 | −10.8 | −15.48 | 1.81 | 1.40 | 109 | 139 |
| 2.2 | −0.261 | −1.08 | −12.0 | −16.3 | 4.61 | 2.98 | −13.5 | −16.72 | 1.53 | 1.34 | 125 | 194 |
| 2.3 | 0.001 | −0.68 | −14.1 | −16.3 | 3.48 | 2.90 | −14.5 | −30.11 | 1.46 | 1.06 | 129 | 200 |
| 2.4 | 0.109 | −0.76 | −14.9 | −16.3 | 3.11 | 2.94 | −15.1 | −16.56 | 1.43 | 1.35 | 132 | 142 |
| 2.5 | 0.152 | −0.84 | −14.9 | −16.6 | 3.11 | 2.87 | −15.0 | −11.39 | 1.43 | 1.74 | 132 | 188 |
| 2.6 | 0.277 | −0.42 | −14.4 | −17.2 | 3.25 | 2.54 | −13.9 | −10.80 | 1.50 | 1.81 | 126 | 310 |
| 2.7 | 0.571 | −0.12 | −13.6 | −17.1 | 3.46 | 2.48 | −12.8 | −13.63 | 1.60 | 1.53 | 118 | 269 |
| 2.8 | 0.843 | 0.15 | −13.0 | −17.1 | 3.59 | 2.39 | −12.4 | −21.82 | 1.63 | 1.41 | 115 | 183 |
| 2.9 | 0.985 | 0.65 | −12.8 | −17.5 | 3.61 | 2.16 | −12.7 | −27.11 | 1.60 | 1.09 | 118 | 194 |
| 3.0 | 1.220 | 0.83 | −12.7 | −16.8 | 3.56 | 2.29 | −14.1 | −21.85 | 1.49 | 3.18 | 127 | 221 |
| 3.1 | 1.680 | 1.02 | −11.8 | −16.6 | 3.73 | 2.30 | −15.7 | −26.17 | 1.39 | 1.10 | 135 | 184 |
| 3.2 | 1.99 | 1.41 | −11.0 | −17.5 | 3.98 | 1.97 | −15.8 | −24.68 | 1.39 | 1.12 | 136 | 169 |
| 3.3 | 2.04 | 1.48 | −10.8 | −17.7 | 4.01 | 1.91 | −14.0 | −18.35 | 1.50 | 1.27 | 128 | 171 |
| 3.4 | 2.27 | 1.69 | −10.8 | −16.4 | 3.91 | 2.17 | −12.5 | −17.11 | 1.62 | 1.32 | 117 | 203 |
| 3.5 | 2.64 | 2.14 | −10.0 | −15.7 | 4.12 | 2.25 | −12.0 | −18.70 | 1.67 | 1.26 | 113 | 207 |
| 3.6 | 2.82 | 2.20 | −9.48 | −16.0 | 4.30 | 2.14 | −12.5 | −18.61 | 1.63 | 1.26 | 116 | 217 |
| 3.7 | 3.12 | 2.58 | −9.50 | −16.1 | 4.14 | 2.02 | −14.3 | −19.87 | 1.48 | 1.22 | 130 | 213 |
| 3.8 | 3.56 | 2.68 | −8.93 | −17.0 | 4.20 | 1.81 | −15.4 | −19.65 | 1.41 | 1.23 | 135 | 209 |
| 3.9 | 3.72 | 2.90 | −8.33 | −15.0 | 4.43 | 2.23 | −15.1 | −18.49 | 1.42 | 1.27 | 132 | 230 |
| 4.0 | 3.79 | 3.21 | −8.56 | −13.9 | 4.27 | 2.44 | −13.0 | −22.63 | 1.58 | 1.16 | 119 | 211 |
| 4.1 | 3.75 | 3.39 | −8.26 | −12.7 | 4.27 | 2.75 | −11.7 | −20.29 | 1.74 | 1.21 | 109 | 218 |
| 4.2 | 3.94 | 3.65 | −8.41 | −12.4 | 4.24 | 2.75 | −14.1 | −23.78 | 1.70 | 1.14 | 111 | 212 |
| 4.3 | 4.43 | 3.71 | −7.97 | −12.7 | 4.44 | 2.65 | −15.6 | −25.61 | 1.49 | 1.11 | 127 | 207 |
| 4.4 | 4.62 | 3.98 | −7.41 | −13.4 | 4.29 | 2.37 | −12.9 | −22.20 | 1.40 | 1.17 | 135 | 186 |
| 4.5 | 4.62 | 4.15 | −7.70 | −12.8 | 4.21 | 2.50 | −11.2 | −19.53 | 1.59 | 1.24 | 122 | 203 |
| 4.6 | 4.81 | 4.18 | −7.67 | −15.6 | 4.37 | 1.78 | −11.4 | −20.39 | 1.76 | 1.21 | 108 | 196 |
| 4.7 | 4.94 | 4.22 | −7.23 | −23.3 | 4.22 | 0.74 | −13.4 | −21.98 | 1.74 | 1.17 | 108 | 199 |
| 4.8 | 5.14 | 4.25 | −7.32 | −11.3 | 4.13 | 2.92 | −15.1 | −16.33 | 1.54 | 1.36 | 123 | 208 |

TABLE 10-continued

Boresight RHC Gain, LHC Gain, Axial Ratio, S11, VSWR, and Impedance Comparison of a Polygonal and Circular Spiral Antenna at Low Frequencies

| FREQ. | GAIN (dB) RHC | | GAIN (dB) LHC | | AXIAL RATIO (dB) | | S11 (dB) | | VSWR | | Input Impedance (Ω) | |
|---|---|---|---|---|---|---|---|---|---|---|---|---|
| (GHz) | Circ. | Poly. | Circ. | Poly. | Circ. | Poly. | Circ. | Poly. | Circ. | Poly. | Circ. | Poly. |
| 4.9 | 5.48 | 4.25 | −7.17 | −7.8 | 4.24 | 4.34 | −13.4 | −21.57 | 1.42 | 1.18 | 132 | 213 |
| 5.0 | 5.47 | 4.28 | −6.94 | −8.4 | 4.05 | 4.12 | −11.4 | −17.40 | 1.54 | 1.31 | 125 | 199 |
| 5.1 | 5.02 | 4.64 | −7.70 | −11.4 | 4.09 | 2.76 | −8.94 | −19.24 | 2.11 | 1.25 | 93 | 216 |
| 5.2 | 5.27 | 4.61 | −7.67 | −11.4 | 4.05 | 2.76 | −7.93 | −17.11 | 2.34 | 1.32 | 94 | 215 |
| 5.3 | 5.24 | 4.75 | −7.57 | −10.3 | 3.73 | 3.10 | −7.93 | −18.87 | 2.36 | 1.26 | 98 | 226 |
| 5.4 | 5.66 | 4.79 | −8.25 | −9.96 | 3.51 | 3.22 | −9.24 | −24.46 | 2.04 | 1.13 | 110 | 196 |
| 5.5 | 5.99 | 4.84 | −8.35 | −9.27 | 3.37 | 3.47 | −12.0 | −18.12 | 1.67 | 1.28 | 334 | 199 |
| 5.6 | 6.11 | 4.81 | −8.35 | −8.22 | 2.82 | 3.94 | −14.74 | −19.20 | 1.45 | 1.25 | 157 | 210 |
| 5.7 | 6.35 | 4.97 | −9.75 | −10.3 | 2.31 | 3.03 | −16.96 | −18.70 | 1.33 | 1.26 | 172 | 216 |
| 5.8 | 6.38 | 5.17 | −11.37 | −12.0 | 1.37 | 2.43 | −19.83 | −23.29 | 1.22 | 1.15 | 176 | 193 |
| 5.9 | 6.48 | 5.24 | −15.76 | −12.8 | 1.03 | 2.19 | −23.88 | −17.47 | 1.14 | 1.31 | 173 | 188 |
| 6.0 | 6.55 | 5.26 | −18.02 | −13.2 | 1.04 | 2.09 | −24.61 | −16.17 | 1.13 | 1.37 | 167 | 209 |

As previously noted, devices prepared according to principles of the invention offer the opportunity to produce electromagnetic radiation with an axial ratio under 3 dB for 93%-99% of its bandwidth, depending on the particular embodiment or device, while preserving the advantages of a square spiral antenna. The radiation patterns obtained from the proposed polygonal geometry are compared to that obtained from purely circular and purely square patterns having the same diameter and the significant improvement in axial ratio is demonstrated in the results. Having the benefit of the present disclosure, one of skill in the art will readily develop further modifications, variants and derivatives of the disclosed geometries and devices exhibiting performance and characteristics beneficially applied to any number of related applications.

Simulations of further embodiments suggest that the inventive antenna device can readily produce 3 dB axial ratios at discrete frequencies 2.1-2.5 GHz and at 3.3 GHz. This phenomenon can be attributed to the fact that the current wavelengths corresponding to these frequencies are located at the transition points of the polygonal geometry. As noted above, FIG. 16 illustrates current distributions in adjacent loops when the antenna is operating at 2.3 GHz.

Figure 17:
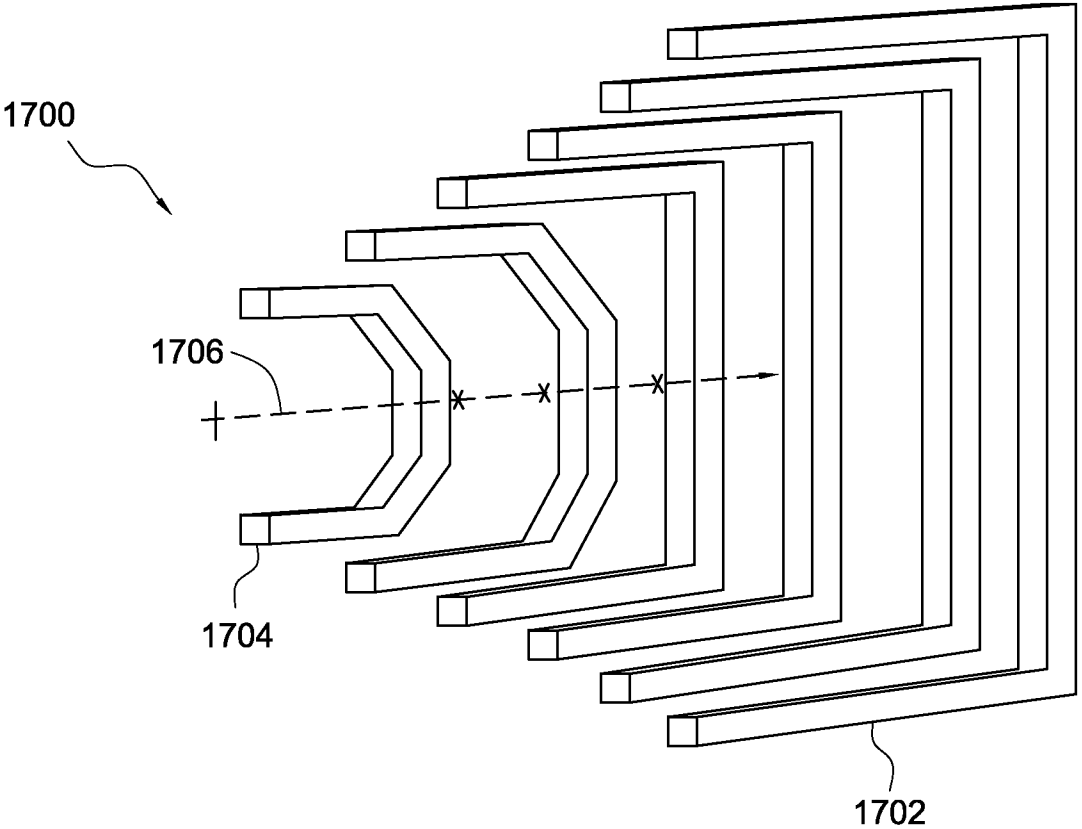
FIG. 17 shows a further aspect of the invention, in cutaway perspective view, including a portion of a helical spiral antenna device.

FIG. 17 shows, in sectional perspective view, a portion of a further antenna device 1700 prepared according to principles of the invention. Like the devices described above, the antenna device 1700 includes a plurality of turns, the turns including a first turn having a first polygonal spiral configuration and a further turn having a second polygonal spiral configuration. For example, the illustrated device 1700, includes a first substantially square polygonal spiral turn 1702 and a further substantially octagonal polygonal spiral turn 1704. The further turn 1704 is disposed radially inward of the first turn 1702. As shown, the antenna device 1700 also includes turns that are offset along an axis 1706 that is disposed normal to a plane defined by the further turn 1704. The result is an antenna device 1700 having a generally polygonal generally helical spiral configuration.

Figure 18:
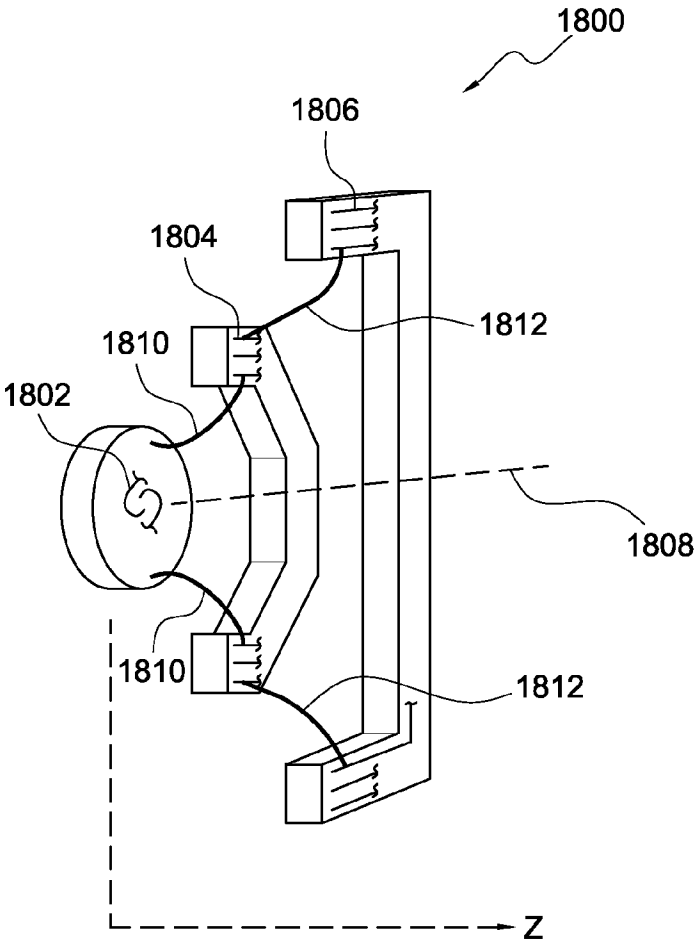
FIG. 18 shows a further aspect of the invention, in cutaway perspective view, including a portion of a helical spiral antenna with coplanar symmetrical loops.

FIG. 18 shows a further embodiment in which an antenna 1800 includes a plurality of groups e.g., 1802, 1804, 1806 of substantially polygonal spiral loops. The loops within each group are generally coplanar with one another. The groups are offset from one another along a longitudinal axis 1808. The loops of each group respectively are signalingly coupled in series with one another, and the groups are likewise coupled in series 1810, 1812. One of skill in the art will appreciate that the representation of FIG. 18 is schematic and contains only exemplary portions of the represented antenna. Various practical implementations may include a larger number of groups, and may incorporate other features described in relation to the previously identified embodiments such as, for example, interpolated loops.

It should also be noted that, while the foregoing description has referred primarily to spirals which are generally Archimedean in form, other configurations of spirals are also considered to be within the scope of the invention.

In a further aspect, the invention includes a method of preparing an antenna device having polygonal spiral loops as described above. In certain aspects, such a method includes using a computer device or computer system to define a plurality of generally polygonal generally spiral geometric curves. Thereafter, these curves may be implemented as a physical antenna by, for example, photochemical etching, computer-aided routing, three-dimensional printing, wire bending, or any other appropriate manufacturing means. The exemplary code below will provide to the practitioner of ordinary skill in the art the understanding necessary to readily implement such a method.

```
//Code for drawing the geometric spiral curves:
//Function for drawing close loop polygons and determining the
//relationship etween the angles
//maximum sides of polygons
#define MAXSIDES 32
// how many turns at each number of sides
#define TURNSPER 4
// how many steps (32, 16, 8, 4) ---> 4 steps
#define NUMSTEPS 4
#define PI 3.14159
// numsides -- how many sides
// ratio of 1.0 means a regular n-gon, 0.0 makes regular n/2-gon
// buffer is where to put results, r1,theta1,r2,theta2....
void make_poly(int numSides,double ratio,double *buffer){
    double shortAngle;
    double longAngle;
    int i;
    double r;
    double theta;
    shortAngle = ratio*2*PI/((double)numSides);
    longAngle = (2*PI − (numSides/2)shortAngle)/((double)numSides/2);
```

-continued

```
    r = 1.0/cos(longAngle/2.0);
    theta = longAngle/2.0;
    for(i = 0;i < numSides;i++){
        buffer[2*i] = r;
        buffer[2*i +1] = theta;
        if(i%2 == 0){
            theta += shortAngle;
        }
        else{
            theta += longAngle;
        }
    }
    return;
}
// Main program for original polygonal spiral
int main(int argc, char **argv){
    int i;
    double ratio;
    int j;
    double buffer[2*MAXSIDES];
    int sides = MAXSIDES;
    int k;
    double r;
    double theta;
    double angleSoFar; // 2*pi*(number of turns completed)
    double radiusPerRadian = 2.0/(NUMSTEPS*TURNSPER*2*PI);
    double x,y;
    for(i = 0;i < NUMSTEPS;i++){
        for(j =0;j < TURNSPER;j++){
            make_poly(sides, 1.0,buffer);
            }
    //at this point, buffer contains polar coords for
            // vertices of a sides-son of width 1. Need to scale it
            // to the proper width for the spiral, then convert to
            // cartesian coords
            for(k = 0;k < sides;k++){
                // unpack coordinates from the buffer
                r = buffer[2*k];
                theta = buffer[2*k+1];
                r *= radiusPerRadian*(angleSoFar + theta);
                x = r*cos(theta);
                y = r*sin(theta);
                printf("%f %f\n",x,y);
            }
            angleSoFar += 2*PI;
        }
        sides /=2;
    }
    return 0;
}
// Main program for 12th interpolated turn
int main(int argc, char **argv){
    int i;
    double ratio;
    int j;
    double buffer[2*MAXSIDES];
    int sides = MAXSIDES;
    int k;
    double r;
    double theta;
    double angleSoFar; // 2*pi*(number of turns completed)
    double radiusPerRadian = 2.0/(NUMSTEPS*TURNSPER*2*PI);
    double x,y;
    int flag = 0;
    for(i = 0;i < NUMSTEPS;i++){
        for(j =0;j <TURNSPER;j++){
            if ((sides == 4) && (j == 0)){
                sides = 8;
                flag = 1;
                make_poly(sides,0.5,buffer);
            }
            else{
                make_poly(sides,1.0,buffer);
            }
            //at this point, buffer contains polar coords for
            // vertices of a sides-gon of width 1. Need to scale it
            // to the proper width for the spiral, then convert to
            // cartesian coords
            for(k = 0; k < sides;k++){
                // unpack coordinates from the buffer
                r = buffer[2*k];
                theta = buffer[2*k+1];
                r *= radiusPerRadian*(angleSoFar + theta);
                x = r*cos(theta);
                y = r*sin(theta);
                printf("%f %f\n",x,y);
            }
            if(flag){
                sides = 4;
            }
            angleSoFar += 2*PI;
        }
        sides /=2;
    }
    return 0;
}
// Main program for last interpolated turns
int main(int argc, char **argv){
    int i;
    double ratio;
    int j;
    double buffer[2*MAXSIDES];
    int sides = MAXSIDES;
    int k;
    double r;
    double theta;
    double angleSoFar; // 2*pi*(number of turns completed)
    double radiusPerRadian = 2.0/(NUMSTEPS*TURNSPER*2*PI);
    double x,y;
    for(i = 0;i < NUMSTEPS;i++){
        for(j =0;j < TURNSPER;j++){
            if((sides > 4) && (j == (TURNSPER - 1))){
                make_poly(sides,0.5,buffer);
            }
            else{
                make_poly(sides,1.0,buffer);
            }
            //at this point, buffer contains polar coords for
            // vertices of a sides-gon of width 1. Need to scale it
            // to the proper width for the spiral, then convert to
            // cartesian coords
            for(k = 0;k < sides;k++){
                // unpack coordinates from the buffer
                r = buffer[2*k];
                theta = buffer[2*k+1];
                r *= radiusPerRadian*(angleSoFar + theta);
                x = r*cos(theta);
                y = r*sin(theta);
                printf("%f %f\n",x,y);
            }
            angleSoFar += 2*PI;
        }
        sides /=2;
    }
    return 0;
}
// Main program for gradually transitioning arms
int main(int argc, char **argv){
    int i;
    double ratio;
    int j;
    double buffer[2*MAXSIDES];
    int sides = MAXSIDES;
    int k;
    double r;
    double theta;
    double angleSoFar; // 2*pi*(number of turns completed)
    double radiusPerRadian = 2.0/(NUMSTEPS*TURNSPER*2*PI);
    double x,y;
    for(i = 0;i < NUMSTEPS;i++){
        for(j =0;j < TURNSPER;j++){
            if(sides > 4){
                make_poly(sides,((double)(4-j))/4.0,buffer);
            }
            else{
                make_poly(sides,1.0,buffer);
            }
```

-continued

```
            //at this point, buffer contains polar coords for
            // vertices of a sides-gon of width 1. Need to scale it
            // to the proper width for the spiral, then convert to
            // cartesian coords
            for(k = 0;k < sides;k++){
                // unpack coordinates from the buffer
                r = buffer[2*k];
                theta = buffer[2*k+1];
                r *= radiusPerRadian*(angleSoFar + theta);
                x = r*cos(theta);
                y = r*sin(theta);
                printf("%f %f\n",x,y);
            }
            angleSoFar += 2*PI;
        }
        sides /= 2;
    }
    return 0;
}
```

An exemplary embodiment of a practical antenna is fabricated on Rogers Type RT5880 Duroid substrate that is 0.02 inches thick. The substrate is copper-clad on both sides, therefore the copper was etched off the back side. This substrate is chosen because it provides the closest permittivity match (∈r=2.20) to air from 2-18 GHz. A 0.06 inch-diameter spacing was used at the feed-points at the center of the antenna structure. The cavity depth is 0.625 inch including the air-gap between the radiator and the absorbing layers.

The antenna is fed in unbalanced co-axial mode from the back of the cavity. A wideband tapered coaxial balun is used that transforms the unbalanced coaxial mode into a balanced two-wire transmission line mode that feeds the spiral antenna. The balun also allows for impedance transformation from the 50Ω impedance of the coaxial line to the impedance of the spiral antenna.

In the design of the balun, the antenna impedance is assumed to be 188 Ohms and to be connected to a 50 Ohm connector. The unbalanced balun is used to feed the antenna with one of its sides grounded to the connector and the other side connected to the center pin of the connector. Using a tapered transmission line design, the grounded side of the balun is tapered until it becomes balanced and then the split ends of the tapered coax balun are soldered to the antenna. Where the total cavity depth is 0.625 inches, the balun height is 0.675 inches. Extra length 0.05 inches is added to allow for soldering the balun to the antenna arms. Similar baluns used for cavity-backed spirals operating at 2-18 GHz are found in commercial models.

While the exemplary embodiments described above have been chosen primarily from the field of radio communication, one of skill in the art will appreciate that the principles of the invention are equally well applied, and that the benefits of the present invention are equally well realized in a wide variety of other applications including, for example, product identification and tracking, material processing, aerospace communications, commercial and defense satellites, GPS systems, microwave direction finding systems and other applications that previously have been used, as well as other systems involving the application of electromagnetic fields and radiation.

Further, while the invention has been described in detail in connection with the presently preferred embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. A wideband antenna comprising:

a first conductor having a first end, a second end, a first longitudinal surface disposed between said first end and said second end, and a first longitudinal axis, said first longitudinal axis defining at least first and second polygonal spiral loops said first and second polygonal spiral loops being signalingly coupled to one another in series, said second polygonal spiral loop being disposed radially outward of said first polygonal spiral loop, said first polygonal spiral loop having a first plurality of segments and a first segment count, said second polygonal spiral loop having a second plurality of segments and a second segment count, said second segment count being less than said first segment count and said first and second segment counts being numerically related as an integer power of two.

2. A wideband antenna as defined in claim 1 wherein respective lengths of said first plurality of segments are all approximately equal to one another.

3. A wideband antenna as defined in claim 1 further comprising a second conductor, said second conductor being geometrically similar to said first conductor, said second conductor being interleaved with said first conductor.

4. A wideband antenna as defined in claim 1 wherein a spiral loop of said second conductor is substantially coaxial to said first spiral loop of said first conductor within a mutual plane of said first and second conductors.

5. A wideband antenna as defined in claim 1 wherein said second conductor is oriented at a rotation of approximately 180° with respect to said first conductor within a mutual plane of said first and second conductors.

6. A wideband antenna as defined in claim 1 wherein each segment of said first and second plurality of segments has a respective segment length and wherein said respective segment lengths increase substantially monotonically between said first end and said second end.

7. A wideband antenna as defined in claim 1 wherein each of said segments of said first and second pluralities of segments has respective endpoints defined by parametric equations of r'=aè/cos(dè/2), x=r' cos(è) and y=r' sin(è).

8. A wideband antenna as defined in claim 1 wherein each of said segments of said first and second pluralities of segments is disposed substantially tangent to a geometric spiral.

9. A wideband antenna as defined in claim 8 wherein said geometric spiral includes an Archimedean spiral.

10. A wideband antenna as defined in claim 1 further comprising:

a further conductor having a further polygonal spiral loop disposed in spaced relation to said second polygonal spiral loop to form an antenna array, wherein a spacing between respective centers of said second polygonal spiral loop and further polygonal spiral loop exceeds a sum of the respective radii of said second and further polygonal spiral loops.

11. A spiral antenna comprising:

a piecewise linear spiral member including a plurality of longitudinal regions disposed adjacent to one another at a respective plurality of vertices, said plurality of vertices having respective angular measures diminishing monotonically from an innermost vertex to an outermost vertex of said spiral along a longitudinal axis of said linear spiral member.

12. A spiral antenna as defined in claim 11 wherein a smallest vertex of said plurality of vertices has an angular dimension of at least about 90°.

13. A spiral antenna as defined in claim 11 wherein a largest vertex of said plurality of vertices has an angular dimension of at most about 179°.

14. A spiral antenna as defined in claim 11 wherein said plurality of longitudinal regions defines at least one polygonal loop having sides of approximately equal length and wherein said plurality of longitudinal regions defines at least one interpolated polygonal loop having sides of substantially different lengths.

15. A spiral antenna as defined in claim 11, further comprising a curved spiral member electrically coupled to said piecewise linear spiral member.

16. A spiral antenna as defined in claim 11 wherein said plurality of longitudinal regions defines at least a first loop and a second loop, said first loop having a number of sides taken over 360° related as a power of 2 to a number of sides taken over 360° of said second loop.

17. A method of communicating comprising:

stimulating an electronic signal in a spiral antenna, said spiral antenna including a generally spiral longitudinal member, said generally spiral longitudinal member including a first region describing an approximately rectangular polygonal spiral and a second region describing an approximately non-rectangular polygonal spiral, wherein said second region approximates a polygon having a number of sides, said number of sides equal to two raised to a power of two.

18. A method of communicating as defined in claim 17 wherein said second region is disposed inwardly of said first region.

19. A method of communicating as defined in claim 17 wherein said first and second regions are disposed substantially coplanar to one another.

20. A method of communicating as defined in claim 17 wherein said spiral antenna comprises a substantially electrically conducting material.

21. A method of communicating as defined in claim 20 wherein said substantially electrically conducting material comprises at least one of copper, aluminum, silver, and gold.

22. A method of communicating as defined in claim 17 wherein said spiral antenna comprises an Electromagnetic Bandgap material.

23. A method of communicating as defined in claim 17 wherein said spiral antenna comprises a meta material.

24. A method of communicating as defined in claim 17 wherein said first region has a further number of sides, said further number of sides being equal to two raised to a further power of two, said first and second powers of two differing by an integer value of at least two.

* * * * *